US008215618B2

(12) United States Patent
Kochan et al.

(10) Patent No.: US 8,215,618 B2
(45) Date of Patent: Jul. 10, 2012

(54) POWER CABLE

(75) Inventors: Stephen J. Kochan, Skaneateles, NY (US); Michael S. Murphy, Baldwinsville, NY (US)

(73) Assignee: J.R. Clancy, Inc., Syracuse, NY (US)

( * ) Notice: Subject to any disclaimer, the term of this patent is extended or adjusted under 35 U.S.C. 154(b) by 550 days.

(21) Appl. No.: 12/413,887

(22) Filed: Mar. 30, 2009

(65) Prior Publication Data

US 2009/0242861 A1 Oct. 1, 2009

Related U.S. Application Data

(60) Provisional application No. 61/040,749, filed on Mar. 31, 2008.

(51) Int. Cl.
*B66D 1/00* (2006.01)

(52) U.S. Cl. ..... 254/266; 254/278; 362/404; 362/428

(58) Field of Classification Search ..... 254/266, 254/278; 362/291, 404, 428
See application file for complete search history.

(56) References Cited

U.S. PATENT DOCUMENTS 2,942,879 A 6/1960 Izenour
4,449,700 A * 5/1984 Erpelding ..... 266/79
5,556,195 A 9/1996 Glebe
5,570,546 A 11/1996 Butterworth et al.
6,390,012 B1 * 5/2002 Watt et al. ..... 114/322
7,063,306 B2 * 6/2006 Sanders et al. ..... 254/361
7,153,001 B2 12/2006 Kim
7,201,366 B2 * 4/2007 Sanders et al. ..... 254/361

* cited by examiner

*Primary Examiner* — Emmanuel M Marcelo
(74) *Attorney, Agent, or Firm* — George R. McGuire; David B. Woycechowsky; Bond Schoeneck & King

(57) ABSTRACT

A winch system with a force cable that transmits electrical current and/or digital data to the load. For example, the force cable, including a power line and/or a signal line and includes at least: (i) a first portion extending from the load to the drum; and (ii) a second portion that is wound around the drum. If there is a power line in the force cable it is electrically connected to an electrical commutator by a rotating current path. If there is a signal line in the force cable it is connected in data communication to a data signal commutator by a rotating communication path. The commutator also has an input for receiving electrical current and/or digital data, as appropriate. The commutator transmits the electrical current and/or digital data from its input to the rotating current path and/or communication path. The drum defines an axial channel extending from at least one end of the drum along its axial direction, and current path(s) and/or communication path(s) are routed through the channel. There is a distribution box at a first axial end of the drum and the commutator is at the second axial end of the drum. The drum includes at least one radial channel that includes: (i) a first portion for receiving a force bearing member of the force cable from outside of the drum; and (ii) a second portion for guiding at least a portion of the current path(s) and/or the communication path(s) from outside of the drum to the axial channel.

12 Claims, 17 Drawing Sheets

POWER CABLE

RELATED APPLICATION

The present application claims priority to U.S. provisional patent application No. 61/040,749, filed on Mar. 31, 2008; all of the foregoing patent-related document(s) are hereby incorporated by reference herein in their respective entirety(ies).

BACKGROUND OF THE INVENTION

1. Field of the Invention

The present invention relates to winch systems (see DEFINITIONS section) and more particularly to winch systems designed for use with a load that: (i) consumes electrical power (for example, a lamp) and/or (ii) utilizes a control signal (for example, an display screen that displays a display corresponding to a fiber optic video data signal).

2. Description of the Related Art

Conventional lift systems include a force cable, a drum and a load. One end of the force cable is wound around the drum and the other end extends away from the drum, often through pulleys, to a point where it is attached to the load so that the force cable transmits mechanical force to the load. The drum is rotated to wind and unwind the lift cable and thereby move the load. As a simple example, in hand cranked theatre winches the force cable was generally a rope.

Other conventional lifts are electrically powered, such as lifts including an electrical motor. One example of this kind of lift is found in U.S. Pat. No. 2,942,879 ("Izenour"), which discloses a lift system including a motor, a drum, a line and a scenery unit. In the Izenour system, the line is the force cable and the scenery unit is the load. In the Izenour system, the motor powers rotation of the drum to wind and unwind the line, and thereby lift and lower scenery units. Although electrical power is supplied to the motor in Izenour, so that the motor can operate to rotate the drum, no electrical power is supplied to the force cable itself in the Izenour system.

It is conventional for the loads supported, raised and lowered by conventional lift systems to include components that require and consume electrical power. For winch systems that move loads which require electrical power, a separate power cable is conventionally provided. The separate power cable runs from a power supply (for example an electrical utility power outlet) to a power input on the load. Electrical current runs through the power cable from the source to the load and provides electrical power to the load. However the power cable must be able to accommodate the motion of the load caused by the winch system. For example, U.S. Pat. No. 5,570,546 ("Butterworth") discloses a system for raising and lowering telecommunications equipment along a mast pole. The Butterworth system includes lift cables and coaxial signal cables. The lift cables and coaxial signal cables are separate from each other. As will now be discussed, there are several different conventional ways that separate power cables are applied to loads that are moved by winch systems.

The simplest way is called "loose cables," which means that a large length of slack and relatively unconstrained power cable is maintained between the power source and the load. As the load is moved by the winch system, the load will pull an end of the power cable and take up some of the slack. The slack cable may be placed out of the way manually on an ongoing basis to try to ensure that the cable does not: (i) get tangled with people or objects; (ii) does not get caught in moving mechanical equipment; and/or (iii) does not move into an unsightly or view-obstructing position. Although the loose power cable solution does not require any extra equipment, beyond perhaps some extra length of power cable, the challenge of keeping the cables out of the way is burdensome and may even lead to risks of equipment damage or even personal injury.

Some conventional kinds of equipment for handling separate power cables for winch loads include: (i) cable reels; (ii) windlasses; (iii) folding cable trays; (iv) cable baskets; and/or (v) coiling cones. It is believed that these kinds of equipment, and their associated separate power cable handling methods, are and remain in wide use because they perceived by those of ordinary skill to be adequate, effective, cost-effective and optimal solutions to the problem of getting electrical current to a winch load for most winch system applications. For example, U.S. Pat. No. 5,556,195 ("Glebe") discloses a motorized electrical apparatus for movement of an electrical fixture. The Glebe apparatus includes a retractable cable reel assembly for handling a separate power cable.

U.S. Pat. No. 7,153,001 ("Kim"), in describing a certain publication, states the following: "As shown in another related art, i.e., Korean Utility Model Application No. 20-2002-0033396, the wire combination structure of the said lift lighting system comprises a wire 304 having a rope 301, a grounding wire 302 and electric power supply wires 303 in an outer cover 300; a winding reel 306 on which the wire 304, at the end of which the lamp is installed, is rolled, and on one side of which pulleys 305 and 308 is installed; a power supply part 307 in which the pulley 305 is installed on the shaft of the motor 312 to operate the winding reel 306; belt 309 connecting the pulley 305 of the power supply part with the pulley 308 of the winding reel; a bracket 311 fixing the winding reel 306 to the frame 310. In the wire combination structure of the said conventional art, because the rope 301, the grounding wire 302 and the electric power supply wires 303 are combined in one wire, there can be a fall of the lamp owing to the rotation or twist of the lamp itself or the weight of the lamp." (Reference numbers refer to FIGS. 1 to 3 of this document which have been drawn to match FIGS. 1 to 3 of the Kim patent.)

The Kim patent goes on to comment about the disclosure of the preceding paragraph as follows: "In the wire combination structure of the said conventional art, because the rope 301, the grounding wire 302 and the electric power supply wires 303 are combined in one wire, there can be a fall of the lamp owing to the rotation or twist of the lamp itself or the weight of the lamp. In addition, because the width of the winding reel on which a wire is rolled is wide, in case the wire is not rolled regularly on the horizontal direction but is twisted doubly or triply, the lamp itself can be rotated or twisted. And in case that the lamp is lifted up and down by two wires to solve the said problem, the balance of the lamp cannot be kept due to the winding error and the difference of the winding speed."

Electric commutators are conventional. Fiber optic data signal commutators are conventional. Rotary seals in fluid supply lines are conventional.

Description of the Related Art Section Disclaimer: To the extent that specific publications are discussed above in this Description of the Related Art Section, these discussions should not be taken as an admission that the discussed publications (for example, published patents) are prior art for patent law purposes. For example, some or all of the discussed publications may not be sufficiently early in time, may not reflect subject matter developed early enough in time and/or may not be sufficiently enabling so as to amount to prior art for patent law purposes. To the extent that specific publications are discussed above in this Description of the Related Art Section, they are all hereby incorporated by reference into this document in their respective entirety(ies).

BRIEF SUMMARY OF THE INVENTION

A winch system with a force cable that transmits electrical current and/or digital data to the load. For example, the force cable, including a power line and/or a signal line and includes at least: (i) a first portion extending from the load to the drum; and (ii) a second portion that is wound around the drum. If there is a power line in the force cable it is electrically connected (see DEFINITIONS section) to an electrical commutator by a rotating current path. If there is a signal line in the force cable it is connected in data communication (see DEFINITIONS section) to a data signal commutator by a rotating communication path. The commutator also has an input for receiving electrical current and/or digital data, as appropriate. The commutator transmits the electrical current and/or digital data from its input to the rotating current path and/or communication path. Preferably, the drum defines an axial channel extending from at least one end of the drum along its axial direction, and current path(s) and/or communication path(s) are routed through the channel. Preferably, there is a distribution box at a first axial end of the drum and the commutator is at the second axial end of the drum. Preferably, the drum includes at least one radial channel that includes: (i) a first portion for receiving a force bearing member of the force cable from outside of the drum; and (ii) a second portion for guiding at least a portion of the current path(s) and/or the communication path(s) from outside of the drum to the axial channel.

Various embodiments of the present invention may exhibit one or more of the following objects, features and/or advantages:

(1) winch systems with improved cable management;

(2) reduction and/or elimination of cumbersome cable pantographs, slip rings and/or cable reels;

(3) winch systems that move loads at a higher rate of speed;

(4) less costly winch systems;

(5) winch systems that can transfer digital data to a load;

(6) less complicated winch systems and/or winch systems with fewer moving parts;

(7) winch systems that take up less space and/or obstruct vision less;

(8) improved aesthetics;

(9) use of loads that require digital data, such as digital visual displays, digital audio players and digital data controlled LEDs;

(10) improved winch system reliability; and/or

(11) improved winch system safety.

According to an aspect of the present invention, a winch system moves a load. The system includes: a drum defining an outer surface, a central axis, an axial direction, an angular direction and a radial direction; a drum rotating device; a cable jacket; a force member; a current path; and an electrical commutator. The drum is sized, shaped, located and/or connected to selectively rotate the drum about its central axis. The force member is sized, shaped and constituted to have sufficient tensile strength to move the load. The force member extends at least: (i) at least once around the drum in the angular direction, and (ii) from the proximity of the outer surface of the drum in a direction away from the drum. The current path extends at least: (i) from the electrical commutator to the outer surface of the drum, (ii) at least once around the drum in the angular direction, and (iii) from the proximity of the outer surface of the drum in a direction away from the drum. The electrical commutator and drum are sized, shaped, connected and/or located so that at least a portion of the current path rotates about the central axis of the drum with the drum. The electrical commutator is sized, shaped located and/or electrically connected to conduct electrical current between a non-rotating current input/output and a rotating end of the current path. The cable jacket sized, shaped, connected and/or located to wrap around and mutually constrain a portion of the force member and a portion of the current path.

According to a further aspect of the present invention, a winch system moves a load. The system includes: a drum defining an outer surface, a central axis, an axial direction, an angular direction and a radial direction; a drum rotating device; a cable jacket; a force member; a digital data communication path; and a digital data commutator. The drum is sized, shaped, located and/or connected to selectively rotate the drum about its central axis. The force member is sized, shaped and constituted to have sufficient tensile strength to move the load. The force member extends at least: (i) at least once around the drum in the angular direction, and (ii) from the proximity of the outer surface of the drum in a direction away from the drum. The digital data communication path extends at least: (i) from the digital data commutator to the outer surface of the drum, (ii) at least once around the drum in the angular direction, and (iii) from the proximity of the outer surface of the drum in a direction away from the drum. The digital data commutator and drum are sized, shaped, connected and/or located so that at least a portion of the digital data communication path rotates about the central axis of the drum with the drum. The digital data commutator is sized, shaped located and/or electrically connected to provide data communication between a non-rotating digital data input/output and a rotating end of the digital data communication path. The cable jacket is sized, shaped, connected and/or located to wrap around and mutually constrain a portion of the force member and a portion of the digital data communication path.

According to a further aspect of the present invention, a winch system moves a load. The system includes: a drum defining an outer surface, a central axis, an axial direction, an angular direction and a radial direction; a drum rotating device; a cable jacket; a force member; a fluid communication path; and a rotary seal. The drum is sized, shaped, located and/or connected to selectively rotate the drum about its central axis. The force member is sized, shaped and constituted to have sufficient tensile strength to move the load. The force member extends at least: (i) at least once around the drum in the angular direction, and (ii) from the proximity of the outer surface of the drum in a direction away from the drum. The fluid communication path extends at least: (i) from the rotary seal to the outer surface of the drum, (ii) at least once around the drum in the angular direction, and (iii) from the proximity of the outer surface of the drum in a direction away from the drum. The rotary seal and drum are sized, shaped, connected and/or located so that at least a portion of the fluid communication path rotates about the central axis of the drum with the drum. The rotary seal is sized, shaped located and/or electrically connected to provide fluid communication between a non-rotating fluid input/output and a rotating end of the fluid communication path. The cable jacket is sized, shaped, connected and/or located to wrap around and mutually constrain a portion of the force member and a portion of the fluid communication path.

According to a further aspect of the present invention, a winch system moves at least one load(s). The system includes: a winch frame; a motor assembly comprising a motor; a drum defining a central axis, an axial direction, a radial direction, an angular direction, first end and a second end; an electrical commutator comprising a first electrical input/output; a winch junction box; a first in-drum electrical line; a first to-load electrical line; and a first force member. The motor assembly, drum and electrical commutator are each mechanically connected to the winch frame. The motor assembly is operatively connected to the drum to drive the drum to rotate about its central axis relative to the winch frame. The drum further defines an outer peripheral surface, an axial hole extending from the first end to the second end, and a first radial hole extending from the axial hole to the outer peripheral surface. The electrical commutator is located proximate to a portion of the axial hole at the first end. The junction box is located proximate to a portion of the axial hole at the second end and is mechanically connected to the drum so that it rotates with the drum about the central axis of the drum. The first in-drum electrical line extends from the electrical commutator to the junction box through the axial hole, is electrically connected to the first electrical input/output by the electrical commutator, and is electrically connected to the first to-load electrical line by the junction box. The first to-load electrical line is located to extend: (i) from the junction box into the axial hole, (ii) from the axial hole into the first radial hole, (iii) through the first radial hole to the outer peripheral surface of the drum, (iv) at least once around the outer peripheral surface of the drum in the angular direction of the drum, and (v) away from the outer peripheral surface of the drum. The electrical commutator, junction box, axial hole and first radial hole are structured, located and/or connected so that the first in-drum electrical line and at least a portion of the first to-load electrical line rotate with the drum about the central axis of the drum. The first force member is structured and constituted to withstand tensile forces associated with moving the load(s). At least a portion of the first force member is constrained to a portion of the first to-load electrical line to form a first power cable assembly extending from at least: (i) the outer peripheral surface of the drum, (ii) at least once around the outer peripheral surface of the drum in the angular direction of the drum, and (iii) away from the outer peripheral surface of the drum.

BRIEF DESCRIPTION OF THE DRAWINGS

The present invention will be more fully understood and appreciated by reading the following Detailed Description in conjunction with the accompanying drawings, in which.

DETAILED DESCRIPTION OF THE INVENTION

Figure 1:
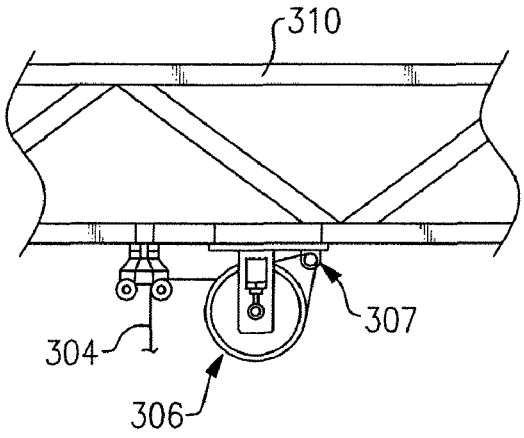
FIG.1 Related Art
FIG. 1 is a an orthographic end view of a winch system according to the prior art.
Figure 2:
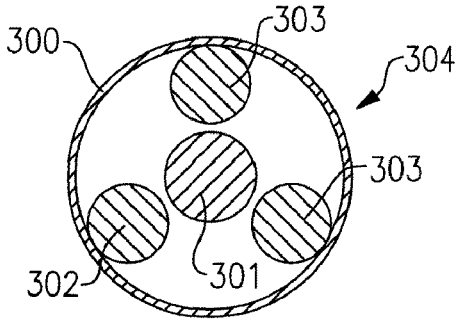
FIG.2 Related Art
FIG. 2 is a cross-sectional view of a wire for use in the winch system of FIG. 1.
Figure 3:
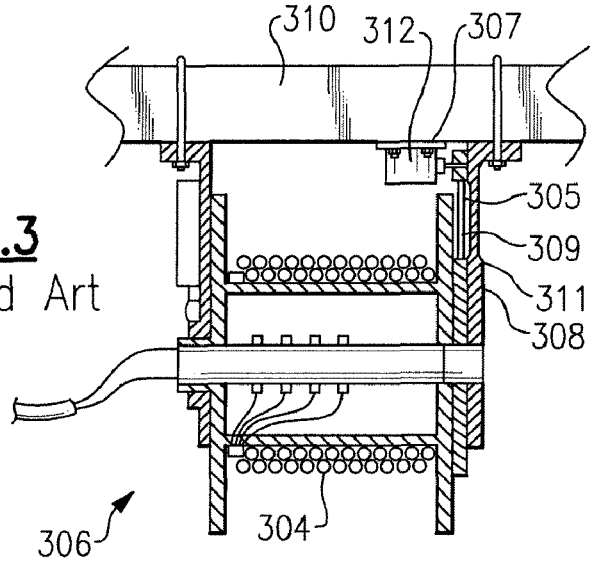
FIG.3 Related Art
FIG. 3 is a cross sectional view of the winch system shown in FIG. 1.
Figure 4:
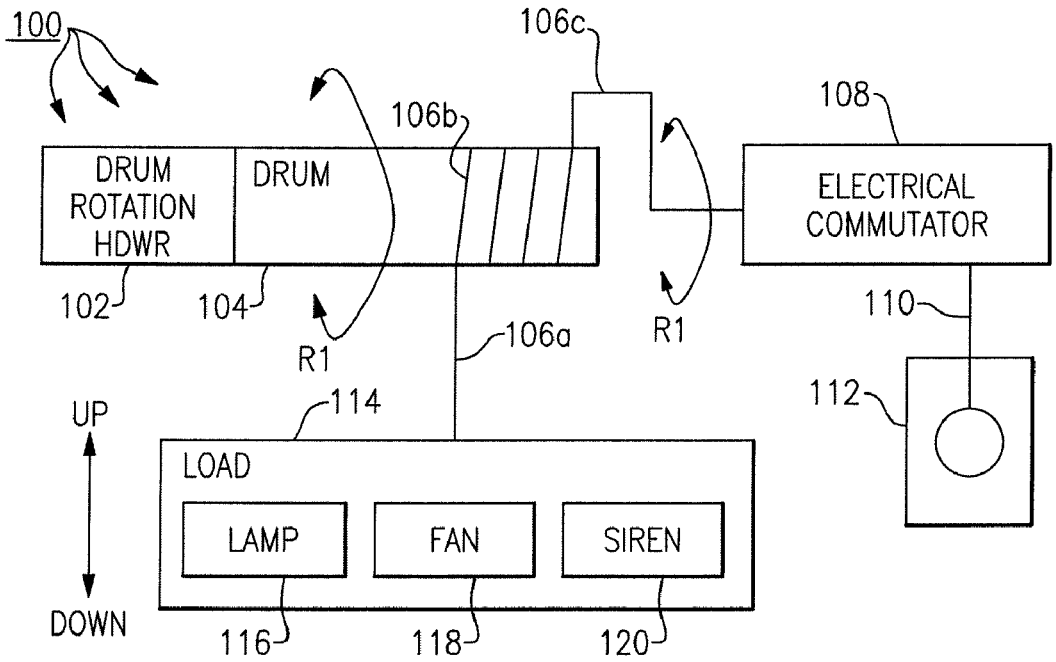
FIG. 4 is a schematic view of a first embodiment of a winch system according to the present invention.

FIG. 4 shows a winch system 100 including: drum rotation hardware 102; rotating drum 104; force cable 106; electrical commutator 108; current input line 110; current supply 112; and load 114. Force cable 106 includes extending portion 106*a*; wound portion 106*b* and rotating portion 106*c*. Load 114 includes: lamp 116, fan 118; and siren 120.

The drum rotation hardware rotates the drum in rotational direction R1 to wind and unwind the extending portion of the force cable to thereby lift and lower the load in the up-down direction indicated in FIG. 4. The force cable may be as simple as a hand crank, or it may be a powered device such as an internal combustion engine or an electric motor.

In system 100, the force cable includes: (i) a force member; and (ii) a current path. The force member is designed to withstand expected operational forces, and extends (in this embodiment) all along the length of the force cable from the load, through the windings and then to the electrical commutator. In system 100, the force cable never enters the interior space of the drum, and the drum has no axial channel and no radial channel. As shown in FIG. 4, when the drum rotates in direction R1, the rotating portion 106*c* of force cable 106 also rotates in direction R1 about the central axis of the drum.

The electrical commutator receives input electrical current from the current supply through the current input line. The electrical commutator can transfer the current from the non-rotating, stationary current input line to a current path (not separately shown) in force cable 106 using any type of electrical commutator hardware now known or to be developed in the future. The current path in force cable transmits current from the electrical commutator all the way to the load, thereby eliminating the need to run a separate power cable to the load. In system 100, the current transmitted to the load serves to power the lamp, the fan and the siren. Of course, the load may additionally or alternatively include other types of power consuming devices. The current transmitted through the current path in the force cable may be alternating current ("AC") or direct current ("DC"). The electrical commutator may convert AC to DC, may convert DC to AC, or it may not convert the form of the current at all. Other power conditioning components, such as transformers, capacitors, etc. could be placed in the current input line, in the electrical commutator and/or even in the current path in the force cable.

In system 100, the force cable only provides mechanical force and electrical current to the load, but does not provide control signals to the power consuming components 116, 118, 120 of the load. While it is true that that if the electrical current is turned off (for example, by unplugging the end of the current supply line from the current supply or by switching off the electrical commutator), then the power consuming components will cease to function for lack of electrical power, but this is not considered to be control because the electrical current is transmitted and applied primarily for power purposes and not for control purposes.

However, in an important variation on system 100, the electrical current supplied through the electrical commutator and the current path to the power consuming components of the load could be a control signal rather than a power signal. As one example, it could be an analog television type signal applied to an analog television type device included in the load. As another example, it could be a digital signal, such as a signal in appropriate format and protocol for turning on and off and/or changing the color of a multitude of discrete LEDs built into the load and controlled directly by an integrated circuit included in the load. As a further alternative, there could be multiple electrical supply lines and multiple current paths running through the force cable, with one or more of the current paths representing electrical power supplies and one or more of the paths carrying electrical control signals.

As a further variation on system 100, electric power and/or electric signals can be transmitted in either direction: (i) from a supply to the load; or (ii) from the load to a current output, such as in input line to an integrated circuit. For example, the load may include a light meter or a strain sensor, and the present invention can be used to communicate electrical (or other form) data signals from the load to the appropriate processing hardware, whether such hardware is located in the main body of the winch itself, or somewhere remote from the main body of the winch itself. If it is desired to communicate electrical signals and/or power in both directions, then separate current paths may be provides to keep the electrical signals separate from each other.

Figure 5:
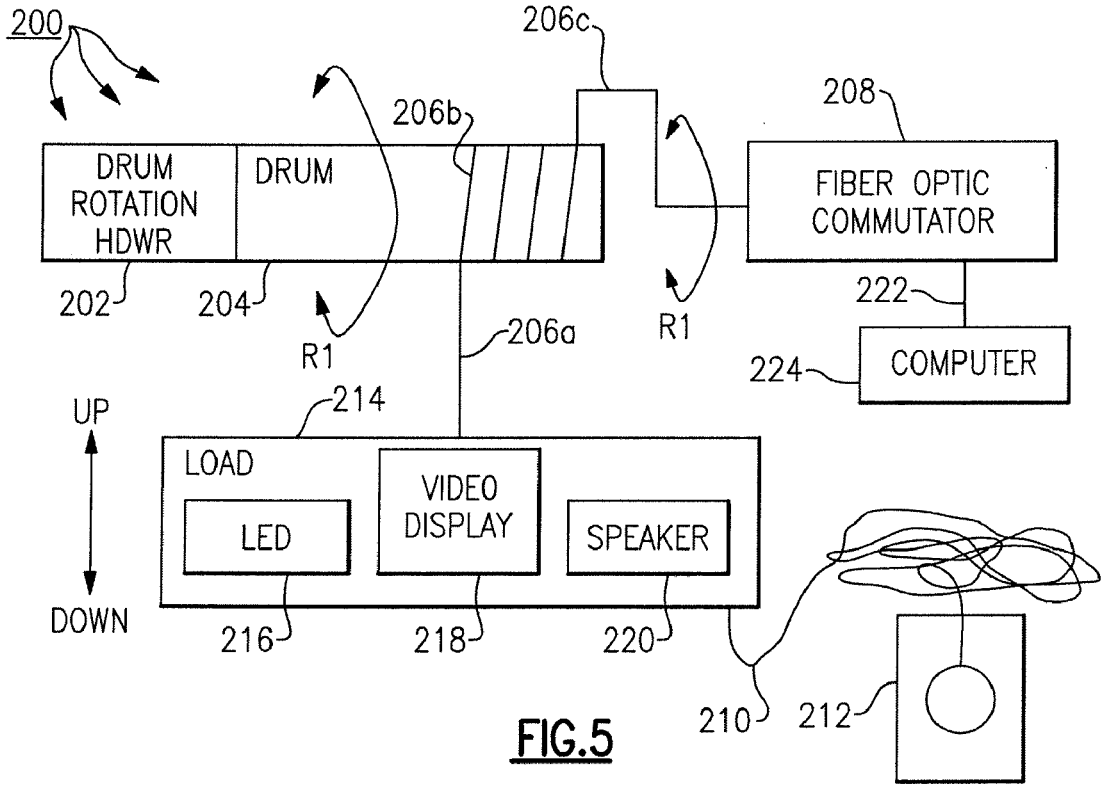
FIG. 5 is a schematic view of a second embodiment of a winch system according to the present invention.

FIG. 5 shows a winch system 200 including: drum rotation hardware 202; rotating drum 204; force cable 206; fiber optic commutator 208; separate power cable 210; current supply 212; load 214; digital data input line 222; and computer 224. Force cable 206 includes extending portion 206*a*; wound portion 206*b* and rotating portion 206*c*. Load 214 includes: LED 216, video display 218; and digital audio speaker 220. Like system 100, the load in system 200 includes power consuming components, which are LED 216, video display 218 and speaker 220. Unlike system 100, in system 200 this power comes from a separate power cable. In this respect system 200 is similar to some of the prior art discussed above.

In system 200, the force cable includes: (i) a force member; and (ii) a fiber optic path. The force member is designed to withstand expected operational forces, and extends (in this embodiment) all along the length of the force cable from the load, through the windings and then to the fiber optic commutator. In system 200, the force cable never enters the interior space of the drum, and the drum has no axial channel and no radial channel. As shown in FIG. 5, when the drum rotates in direction R1, the rotating portion 206*c* of force cable 206 also rotates in direction R1 about the central axis of the drum.

The fiber optic commutator receives input digital data signals from the computer through the digital data input line. This input digital data may be in fiber optic signal form or in other signal form, such as an electrical signal. If the signal is not in fiber optic form, then the fiber optic commutator includes appropriate hardware for converting it to fiber optic form: (i) before it reaches the rotating part of the commutator; (ii) while it is transmitted from the non-rotating part of the commutator to the rotating part of the commutator; or (iii) after it is in the rotating part of the commutator. The fiber optic commutator can transfer the digital data from the non-rotating, stationary digital data input line to the fiber optic path (not separately shown) in force cable 206 using any type of fiber optic commutator hardware now known or to be developed in the future. The fiber optic path in force cable transmits digital data from the fiber optic commutator all the way to the load, thereby allowing control of devices in the load using digital data. In system 200, the digital data transmitted to the load serves to control operation of the LED, the video display and the speaker. Of course, the load may additionally or alternatively include other types of digital data controlled devices. The digital data transmitted through the current path may be in any communication format(s) and/or according to any communications protocol(s) now known or to be developed in the future. Other fiber optic signal conditioning components, such as relays, amplifiers, etc. could be placed in the digital data input line, in the fiber optic commutator and/or even in the fiber optic path in the force cable.

Figure 6:
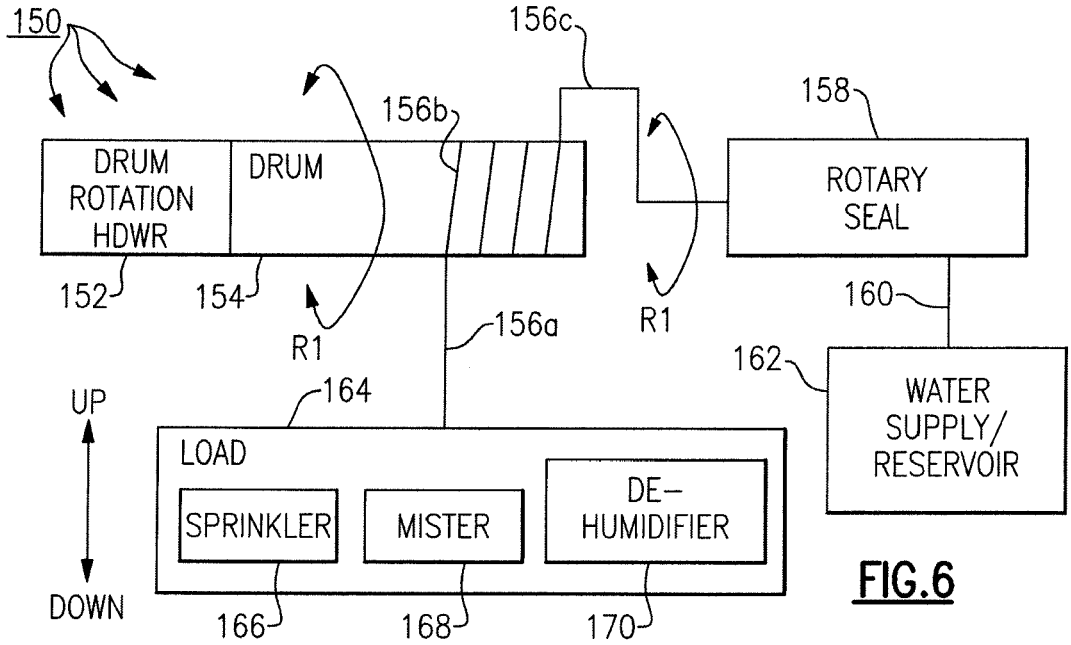
FIG. 6 is a schematic view of a third embodiment of a winch system according to the present invention.

FIG. 6 shows a winch system 150 including: drum rotation hardware 152; rotating drum 154; force cable 156; rotary seal 158; fluid input/output line 160; fluid supply/reservoir 162; and load 164. Force cable 156 includes extending portion 156*a*; wound portion 156*b* and rotating portion 156*c*. Load 164 includes: sprinkler 166, mister 168; and dehumidifier 170.

In system 150, the force cable includes: (i) a force member; and (ii) a fluid conduit. As shown in FIG. 6, when the drum rotates in direction R1, the rotating portion 156*c* of force cable 156 also rotates in direction R1 about the central axis of the drum. The rotary seal fluid communicates water between the fluid input/output line and the rotating end of the fluid conduit at the rotating end of force cable portion 156*c*. More specifically, the sprinkler and the mister included in the load require that water be supplied in order to operate, while the dehumidifier produces water that would be drained through the fluid conduit and the rotary seal. Of course, other types of fluid could be used, such as air, oxygen or pressurized hydraulic fluid.

Figure 7:
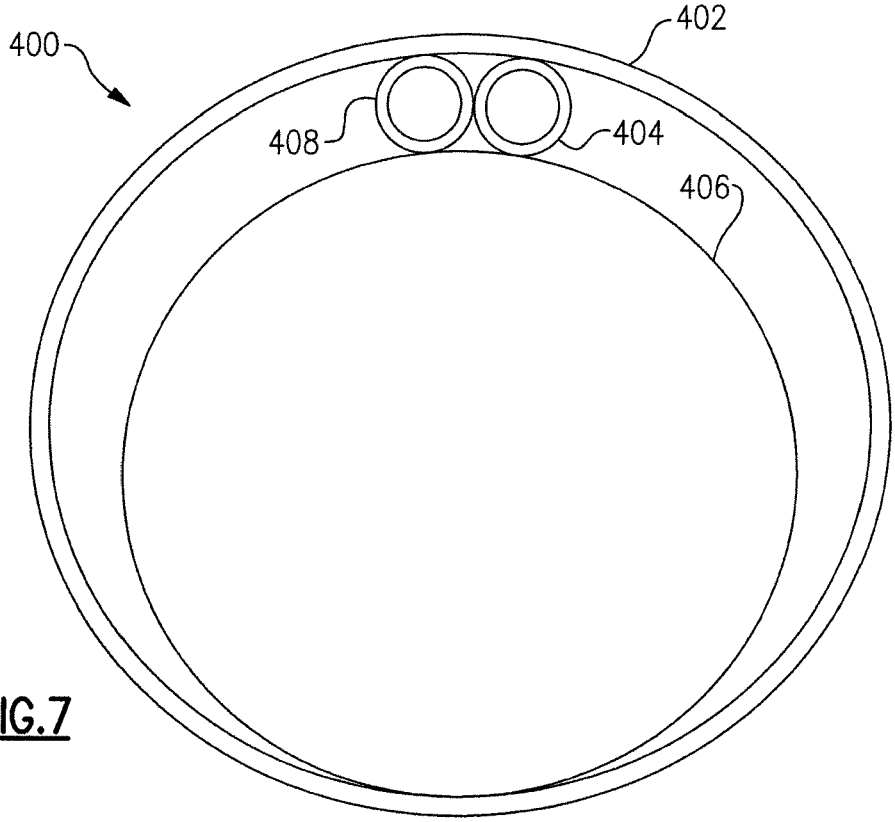
FIG. 7 is a cross sectional view of a first embodiment of a force cable according to the present invention.

FIG. 7 shows a cross section of a force cable assembly 400 according to the present invention including: cable jacket 402; first insulated current carrier 404; high strength rope 406; and second insulated current carrier 408. FIG. 7 shows how the cable jacket constrains the current carriers to the high strength rope. In various embodiments of the present invention, the cable jacket may extend over and around different portions of the current carriers and/or different portions of the high strength rope. For example, in previous described system 100, the current carrier, wire rope and any cable jacket extended all the way from the load back to the electrical commutator. On the other hand, in a preferred embodiment that will be described below, the cable jacket extends from the load back only as far as the outer surface of the drum. In other embodiments of the present invention, the cable jacket may not extend all the way to the load. In some embodiments, any cable jacket may extend to some intermediate location within the windings on the drum. In some embodiments, the cable jacket may continue to wrap around and mutually constrain the high strength rope and current carrier(s) (and/or other types of carriers) to some intermediate point between the outer surface of the drum and the commutator. In still other embodiments of the present invention, the rope may be constrained to any carrier(s) in other ways, for examples: (i) by bands; (ii) by mutual braiding; (iii) by forming or molding the rope around the carriers; and/or (iv) by forming or molding the carrier(s) around the rope.

Cable jacket 402 is preferably polymer scruff resistant jacket or woven scruff resistant jacket.

High strength rope 406 is preferably polymer rope or steel wire rope. In some embodiments of the present invention, the member supplying the force used to move and/or suspend the load may not be in the form of a rope, so long as it: (i) has sufficient tensile strength; and (ii) if sufficiently flexible to be wound around the drum.

First and second insulated current carriers 404, 406 are preferably a stranded electric wire pair of sufficient size and electrical conductivity to carry enough current to supply power or a data signal (for example, a control signal), as appropriate.

Figure 8:
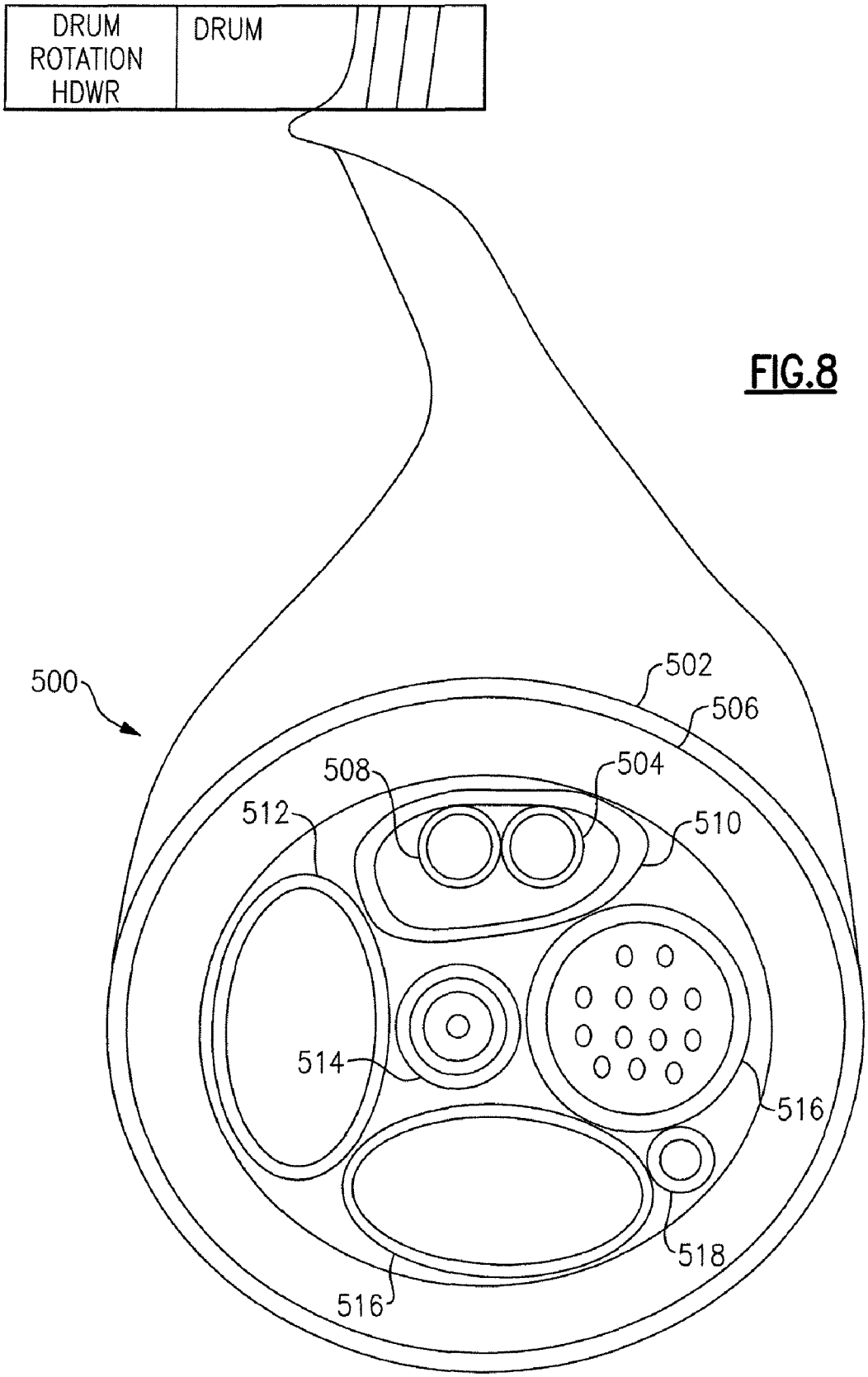
FIG. 8 is a cross sectional view of a second embodiment of a force cable according to the present invention.

FIG. 8 shows an embodiment of a force cable assembly 500 according to the present invention including: jacket 502; first electrical power wire 504; hollow force member 506; second electrical power wire 508; flexible shielding material 510; gas carrier tube 512; coaxial electrical cable 514; liquid carrier tube 516; 13-line computer communication cable 516; and fiber optic line 518. Force cable assembly 500 gives some idea of the wide variety of types of carriers that may (or may not) be included in a force cable assembly according to the present invention.

Figure 9:
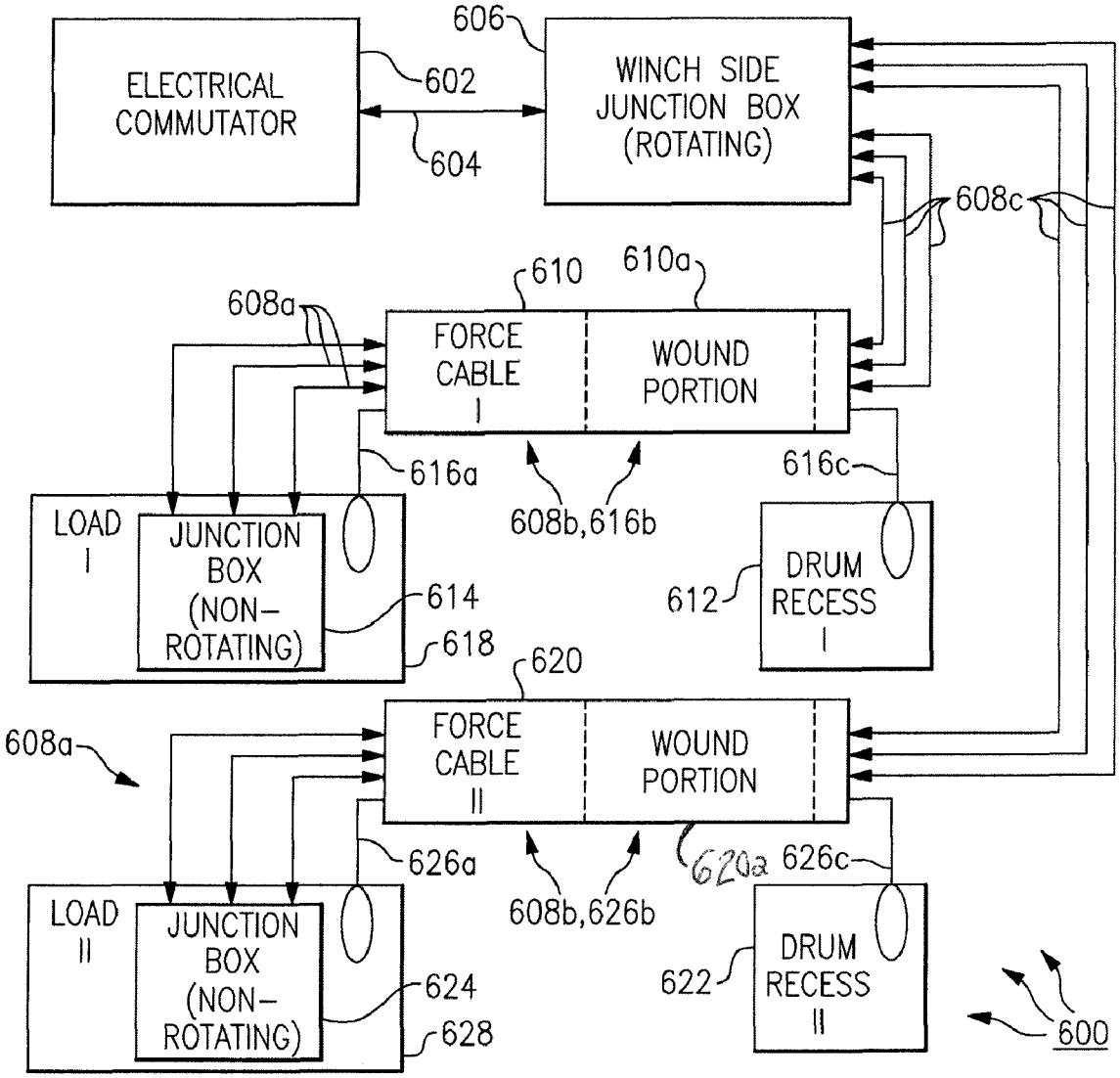
FIG. 9 is a schematic view of a fourth embodiment of a winch system according to the present invention.

FIG. 9 shows a winch system according to the present invention including: electrical commutator 602; first electrical line 604; winch side junction box 608; second electrical lines 608; force cable I 610; drum recess I 612; first force member 616; load I 618 (including load side junction box 614); force cable II 620; drum recess II 622; second force member 626; and load II 628 (including load side junction box 624).

The electrical commutator receives electrical current from a non-rotating electrical input (not separately shown). The electrical commutator transmits this current to first electrical line 604, which rotates with the drum (not shown) of the winch. The first electrical line conducts the current to the winch side junction box, which spits the current among and between six (6) second electrical lines 608. Each second electrical line conducts electrical current from the winch side junction box to the load side junction box and respectively includes: a load-proximate portion 608*a*; a force cable portion 608*b* and a winch proximate portion 608*c*. As shown in FIG. 9, some of the second electrical lines got to force cable I, and others go to force cable II. Alternatively, there could be more or fewer second electrical lines. As a further alternative there could be more or fewer force cable assemblies. As a further variation there could be additional first electrical lines, such as a dedicated first electrical line for each second electrical line.

As shown in FIG. 9, the first force member runs from a recess in the rotating drum to load I and includes: load proximate portion 616*a*, force cable portion 616*b* and winch proximate portion 616*c*. In preferred embodiments of the present invention, the load proximate portion and/or the winch proximate portion may be extremely short or non-existent when the force member is assembled with the second electrical lines over substantially the entire length of the force member. The first force member is assembled with a portion of some of the second electrical lines to form the first force cable assembly 610. Part of this assembly 610 is wound around the drum (not separately shown) of the winch. Part of this assembly also extends away from the drum to load I. As explained above, the first force cable assembly I preferably made by placing a jacket around the second electrical lines and corresponding force member. As shown in FIG. 9, the second electrical lines get current to the loads, and the first and second force members provide the mechanical strength needed to support and/or move these loads.

Figure 10:
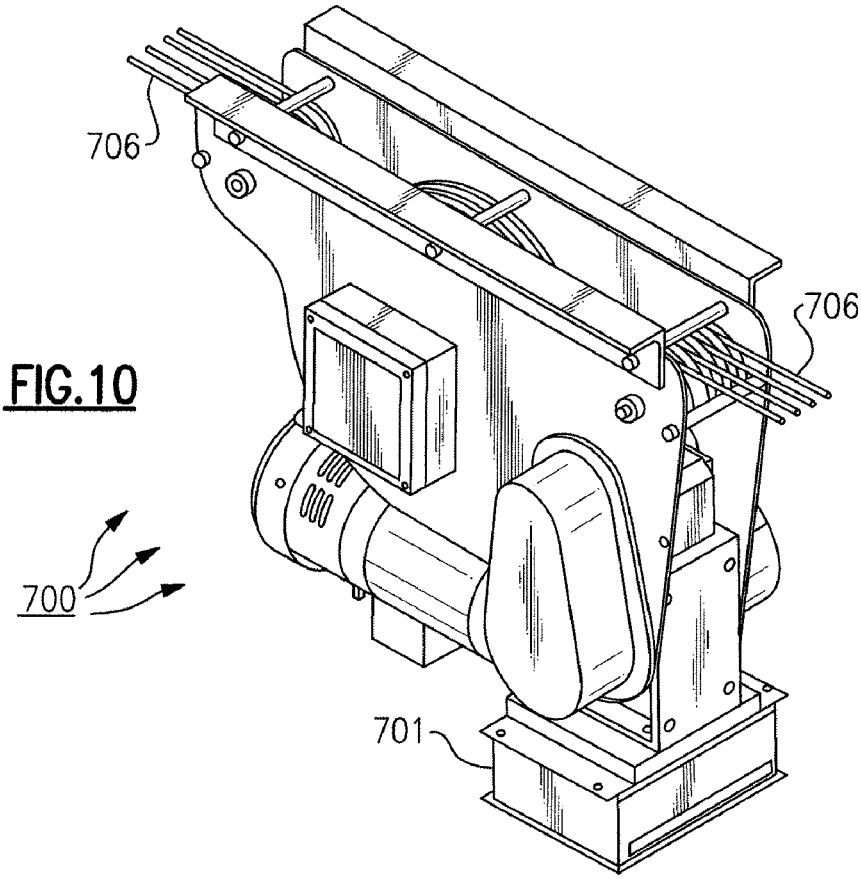
FIG. 10 is a perspective view of a fifth embodiment of a winch system according to the present invention.
Figure 11:
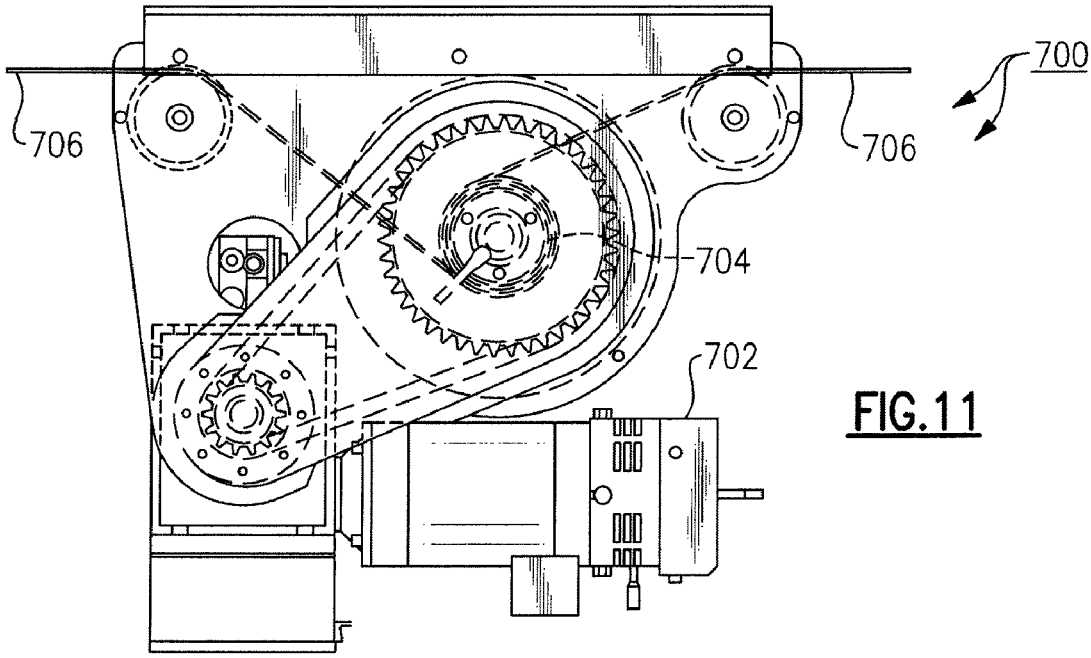
FIG. 11 is an orthographic side view of the fifth embodiment winch system.
Figure 12:
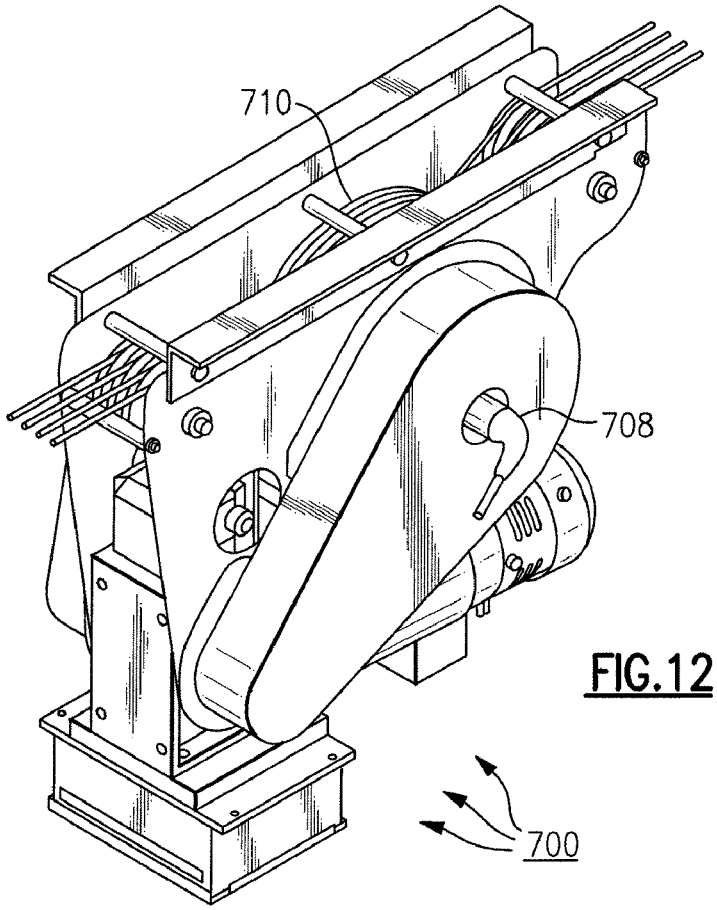
FIG. 12 is a perspective view of the fifth embodiment winch system.
Figure 13:
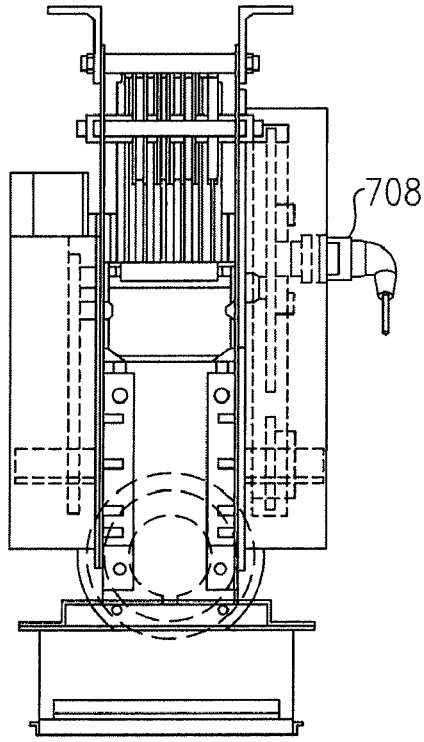
FIG. 13 is an orthographic front view of the fifth embodiment winch system.
Figure 14:
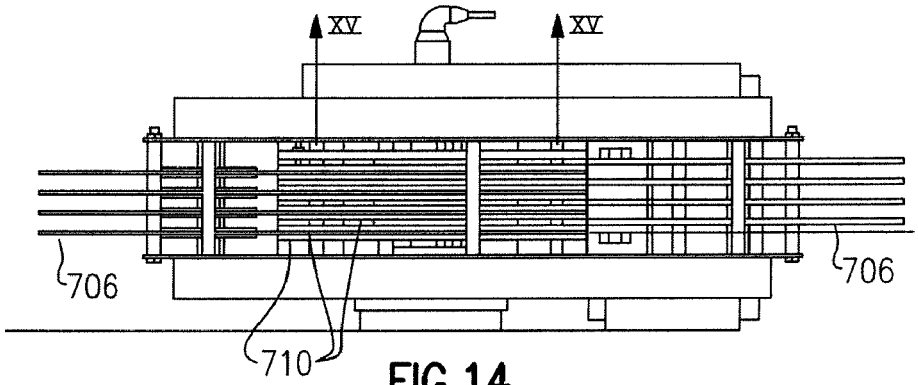
FIG. 14 is an orthographic top view of the fifth embodiment winch system.

FIG. 10 shows winch system 700 including winch frame 701 and eight (8) force cable assemblies 706. As shown in FIG. 11, system 700 further includes electric motor 702. The electric motor is part of an assembly that drives the winch drum to rotate through a gear train and chain. As shown in FIGS. 12 to 14, system 700 includes electrical commutator 708 and a series of radial flanges 710 extending around the drum. Flanges 710 are closely spaced in the axial direction so that they cause each of the eight force cable assemblies to wind and unwind in a respective spiral configuration that piles up on itself. Herein, this is called a pile up geometry or a yo-yo geometry.

Figure 15:
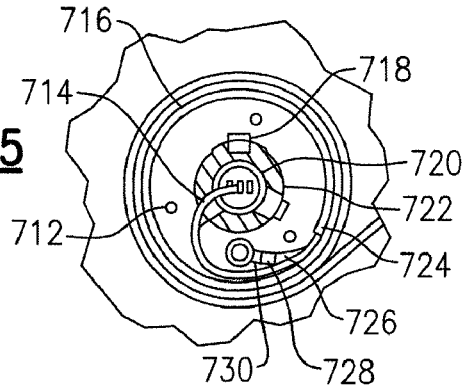
FIG. 15 is a cross sectional view of a portion of the fifth embodiment winch system.

FIG. 15 shows a cross section of the drum taken perpendicular to its central axis, and includes a view of: drum bolt through holes 712; radial channel 714 (housing electrical lines); aluminum drum core plate 716; shaft key 718; axial bore 720; central shaft 722; winch end 724 of a force cable assembly 706; force member 726; press sleeve 728 and cable pin thimble 730. In system 700, the rotating drum is primarily formed by central shaft 722, shaft key 718 and aluminum drum core plate 716. The drum has nine (9) holes formed in it. More specifically, it has: (i) axial bore 720 that extends around the central axis of the drum from one axial end all the way to the other; and (ii) eight (8) spiral shaped radial channels 714 that extend from the central bore radially outward to an outer peripheral surface of the drum. As shown in FIG. 15, electrical lines present in the axial bore extend through the radial channel to the outer surface of the drum. The drum also includes eight force thimble recesses, which are sized and shaped to accept and secure a cable pin thimble 730 at the winch end of each of the eight (8) force members 726. As shown in FIG. 15, the electrical lines and their corresponding force member meet at the outer peripheral surface of the drum, where they are wrapped and constrained by cable jacket 724 to form a force cable assembly 706. The force cable assembly is wrapped around the outer peripheral surface of the drum through at least one (preferably more) windings, or turns, and then extends in a direction away from the drum over a series of intermediate guide pulleys and ultimately to a load.

Figure 16:
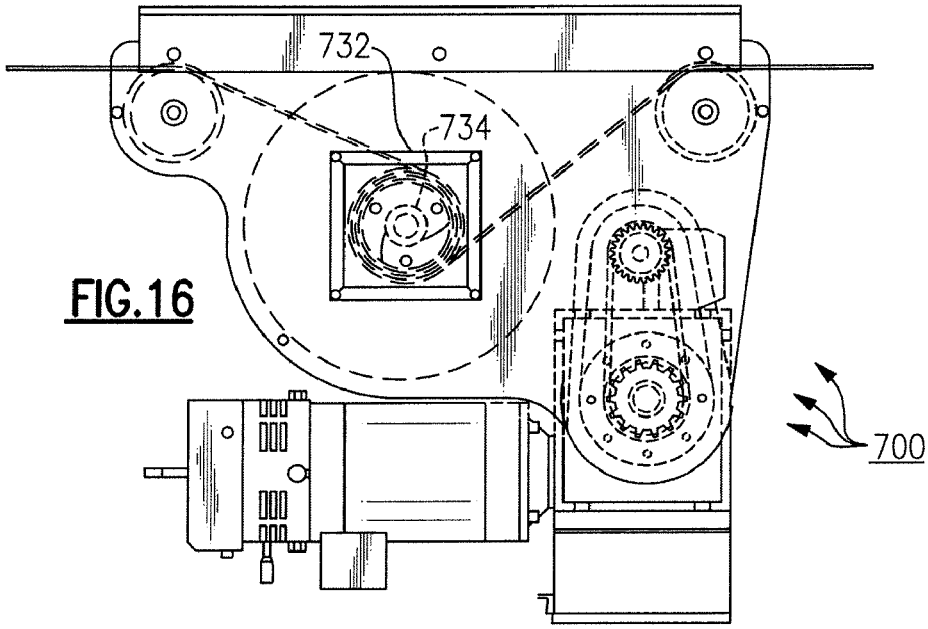
FIG. 16 is an orthographic side view of the fifth embodiment winch system.

FIG. 16 shows on-board rotating junction box 732; and a junction box end 734 of the axial bore. One or more electrical lines extend from electrical commutator 708 (see FIGS. 12 and 13) through the axial bore of the drum to junction box 732 at junction box end 734 of axial bore 720. The junction box includes power and control distribution circuitry so that another set of electrical lines extend from the junction box and back into junction box end 734 of the axial bore. This set of electrical lines extends to, into and through various ones of the eight (8) radial channels to join up with the eight (8) force members and form the eight (8) force cable assemblies.

Figure 17:
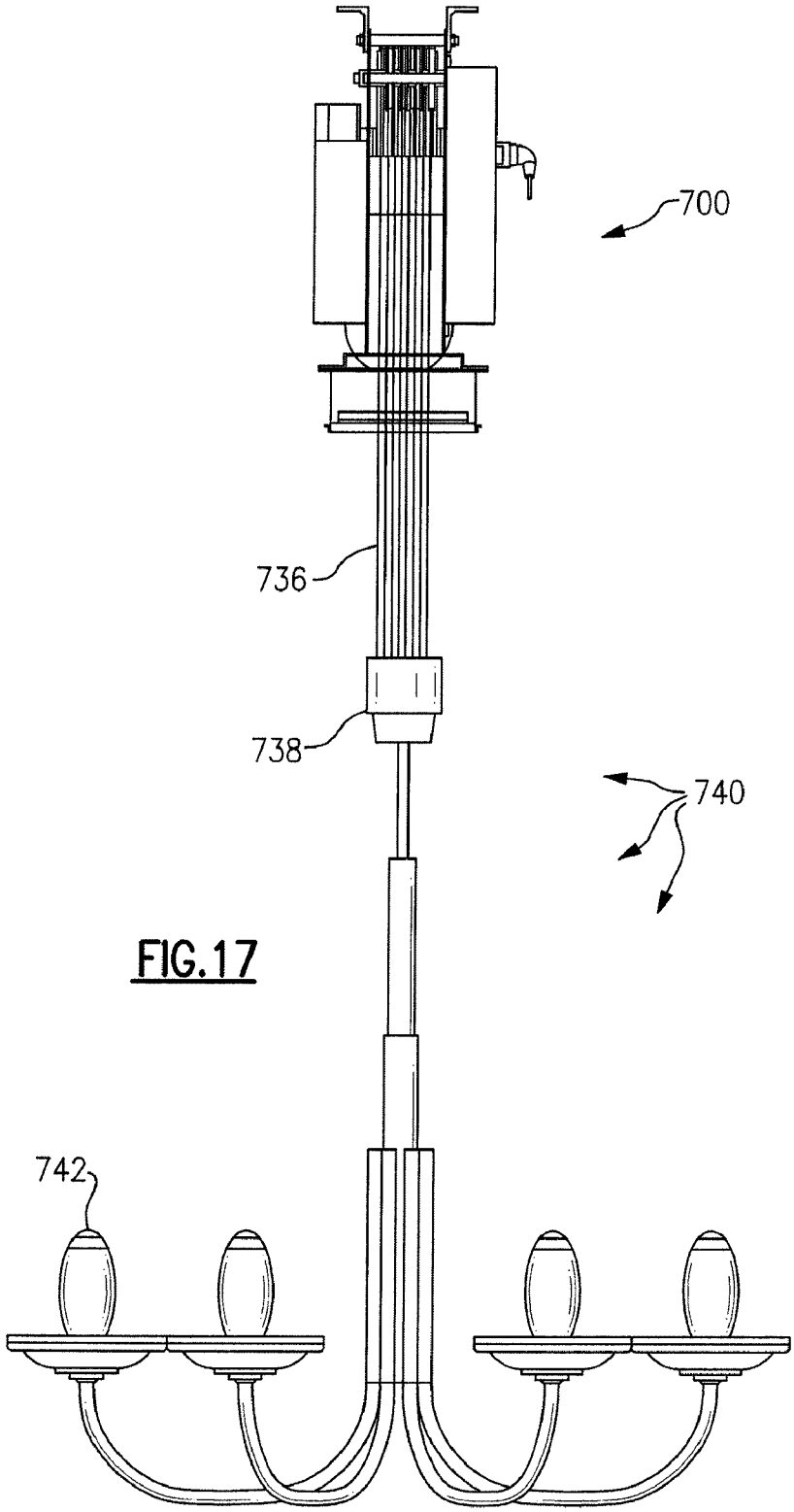
FIG. 17 is a front view of the fifth embodiment winch system supporting a load.

FIG. 17 shows system 700 being used to support and move up and down a load in the form of a gigantic chandelier 740 by a set of force cable assemblies 736. More specifically, the force cable assemblies terminate in load side junction box 738. The electrical lines provide power and/or control for lamps 742 of chandelier 740.

Figure 18:
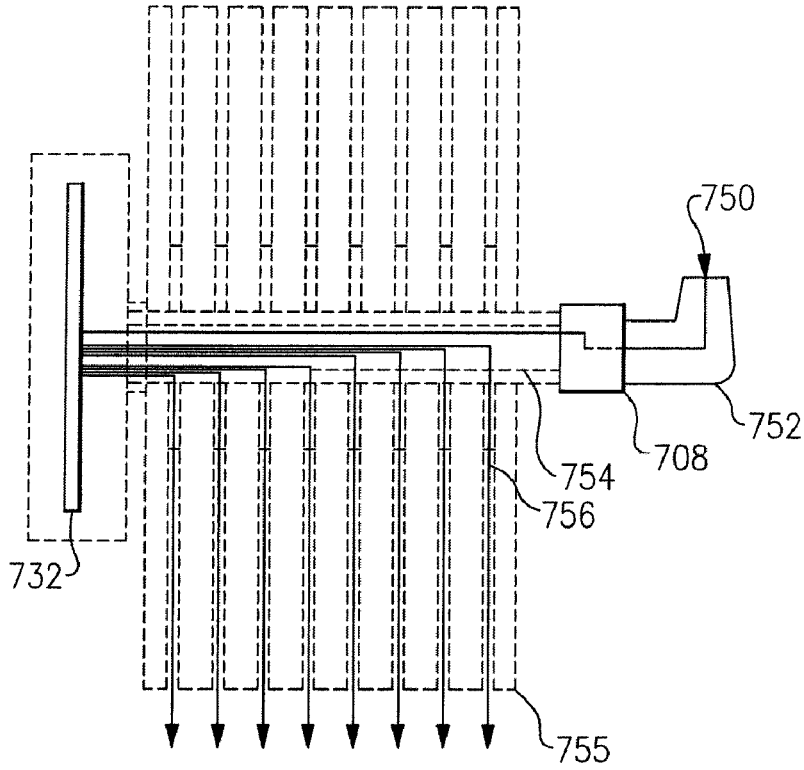
FIG. 18 is a cross sectional view of the fifth embodiment winch system.

FIG. 18 shows a cross section of a portion of system 700 taken in a plane intersecting and perpendicular to the central axis of the drum. As shown in FIG. 18, system 700 further includes electrical current input/output 750; protective boot 752; commutator side end 745 of the axial bore; pile up drum side plates 755 forming the radial flange; and pile up drum core 756. FIG. 18 shows how a first set of electrical lines extend through the axial bore from the commutator to the junction box, and then how a second set of electrical lines extend from the junction box to each of the radial channels, on their way to form the eight (8) force cable assemblies. It is preferred to include a junction box on the rotating side of the commutator because it may decrease the number of separate current paths that must be commutated by the commutator, which can simplify construction of the commutator(s). Alternatively, the junction box could be located between the commutator and the drum, or even within the axial bore.

Figure 19:
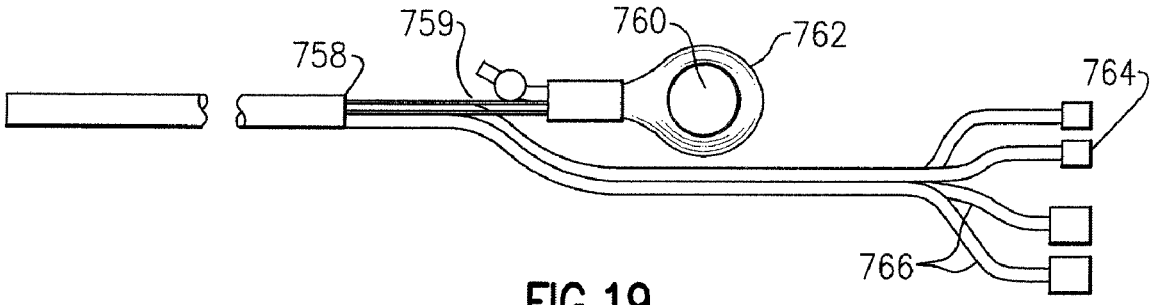
FIG. 19 is a view of a disassembled portion of the fifth embodiment winch system.

FIG. 19 shows the drum side termination of a force cable assembly including cable jacket edge 758; force member 759; eye center region 760; eye termination portion 762 of the force member; in-line electrical connectors 764; and converging portion 766 of several electrical lines. This is the portion of the electrical lines, force member and cable jacket that converge at and/or near the outer peripheral surface of the drum to form the force cable assembly in system 700.

Figure 20:
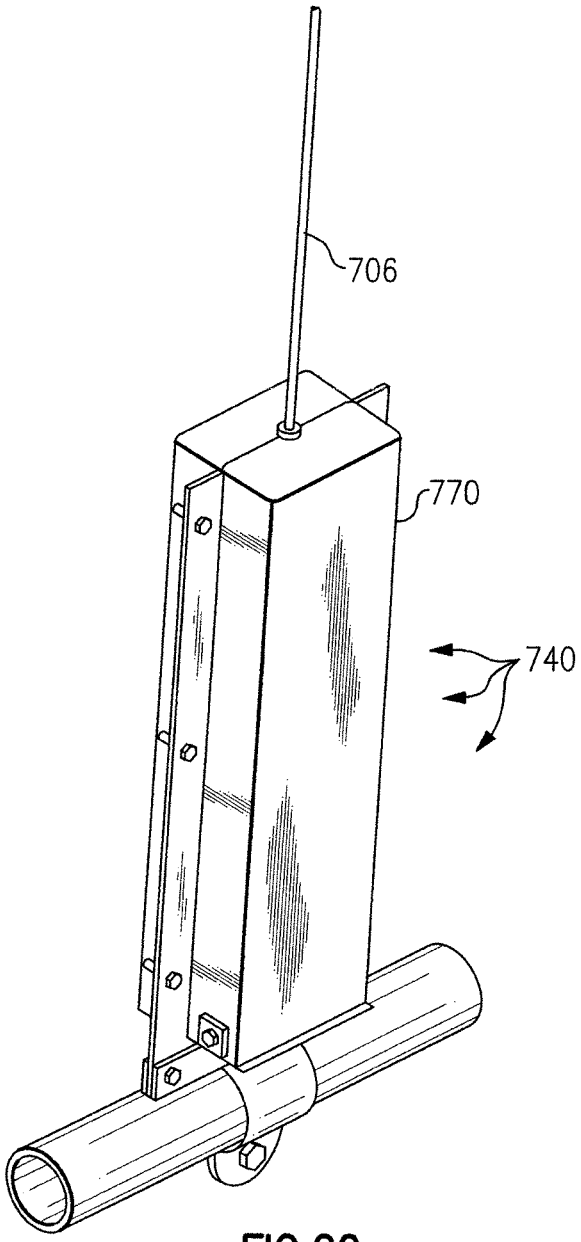
FIG. 20 is a perspective view of a portion of the load of the fifth embodiment winch system.
Figure 21:
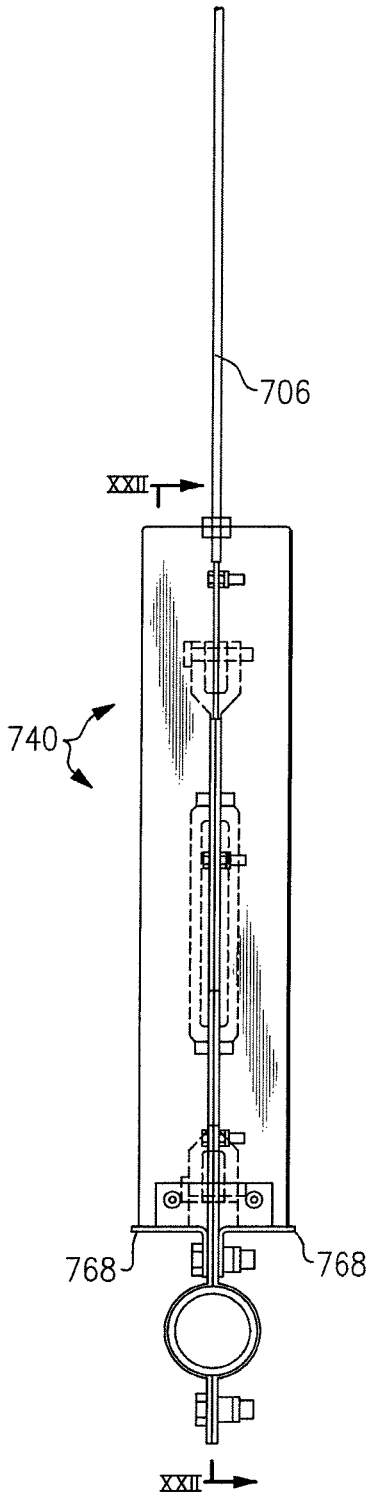
FIG. 21 is an orthographic side view of a portion of the load of the fifth embodiment winch system.
Figure 22:
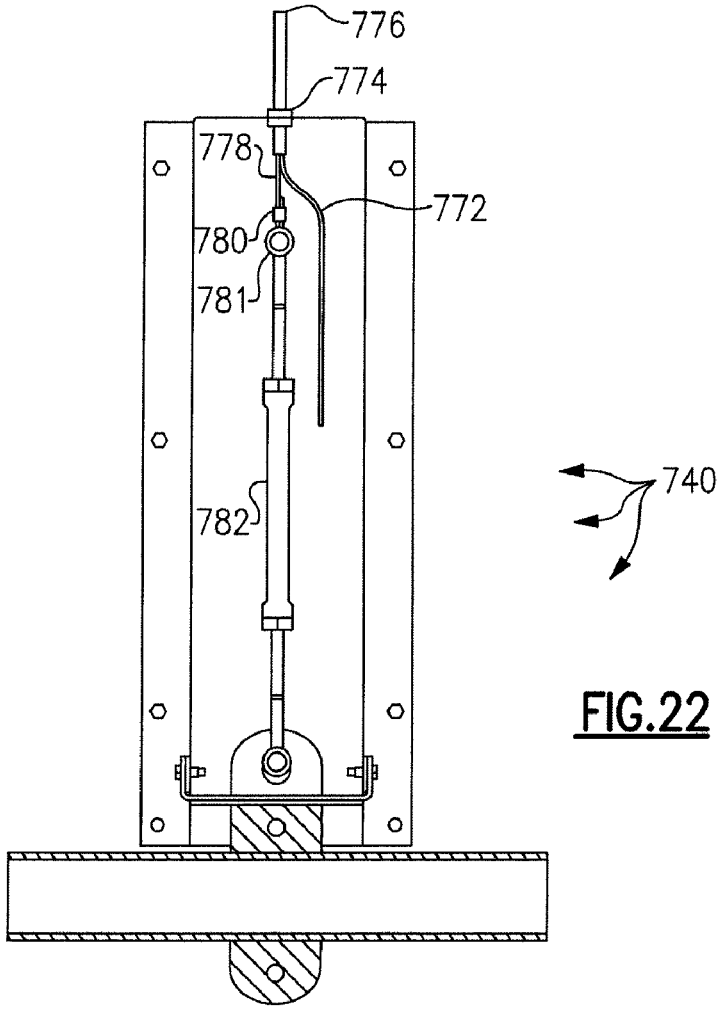
FIG. 22 is a cross sectional view of a portion of the load of the fifth embodiment winch system.

FIGS. 20 to 22 show the load side termination of the force cable assembly including: two 92) part enclosure 770; enclosure mounting brackets 768; diverging portion 772 of the electrical lines; rubber bushing 774; load side end 776 of the force cable assembly; load side end 778 of the force member; press sleeve 780; load side cable thimble pin 781; and turnbuckle 782. The outer diameter of the force cable assembly has an exemplary value of 0.19 inches. the enclosure mounting brackets are bolted to a batten clamp or other hanging bracket. Two holes are preferably provided in the bracket for Liquatite connectors for cable management purposes.

Figure 23:
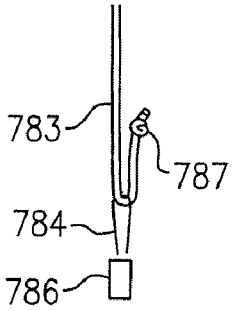
FIG. 23 is an orthographic view of a portion of the assembly process of the fifth embodiment winch system.
Figure 24:
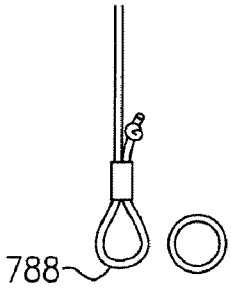
FIG. 24 is an orthographic view of another portion of the assembly process of the fifth embodiment winch system.
Figure 25:
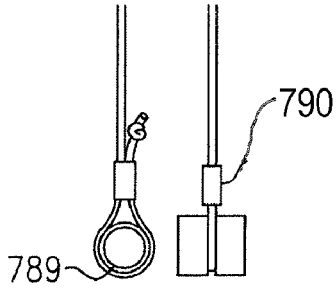
FIG. 25 is an orthographic view of another portion of the assembly process of the fifth embodiment winch system.
Figure 26:
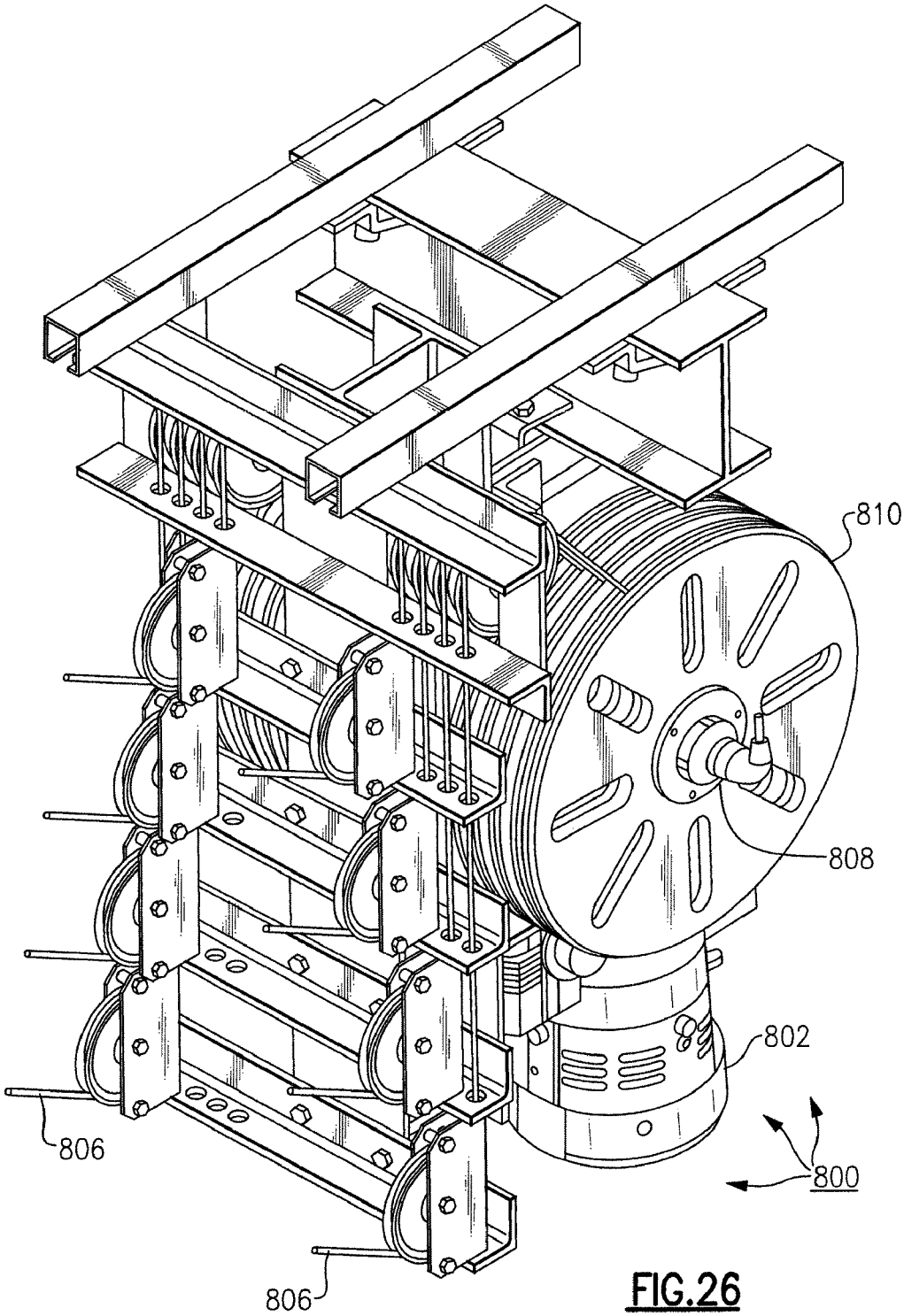
FIG. 26 is a perspective view of a sixth embodiment of a winch system according to the present invention.
Figure 27:
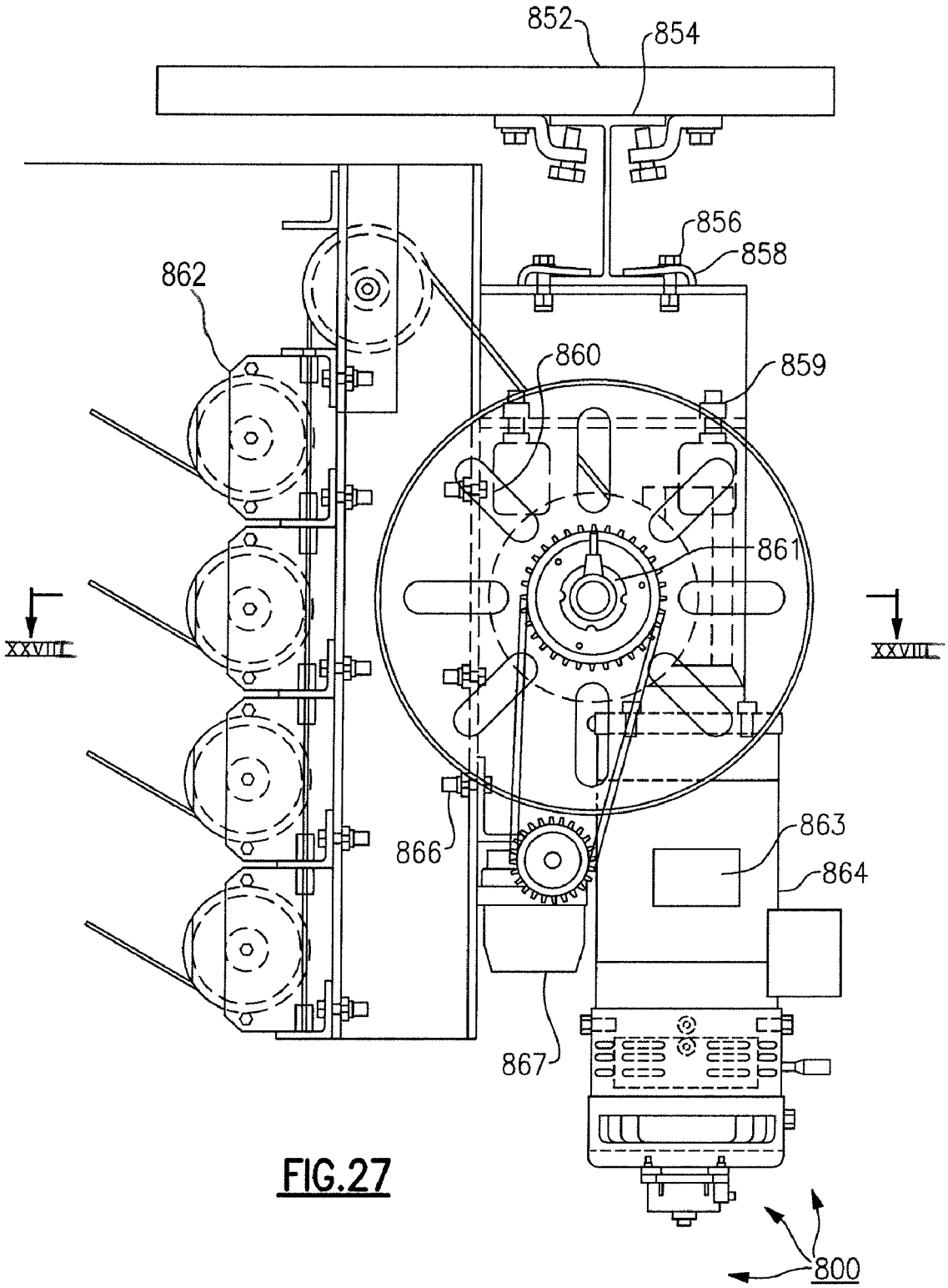
FIG. 27 is an orthographic side view of the sixth embodiment winch system.
Figure 28:
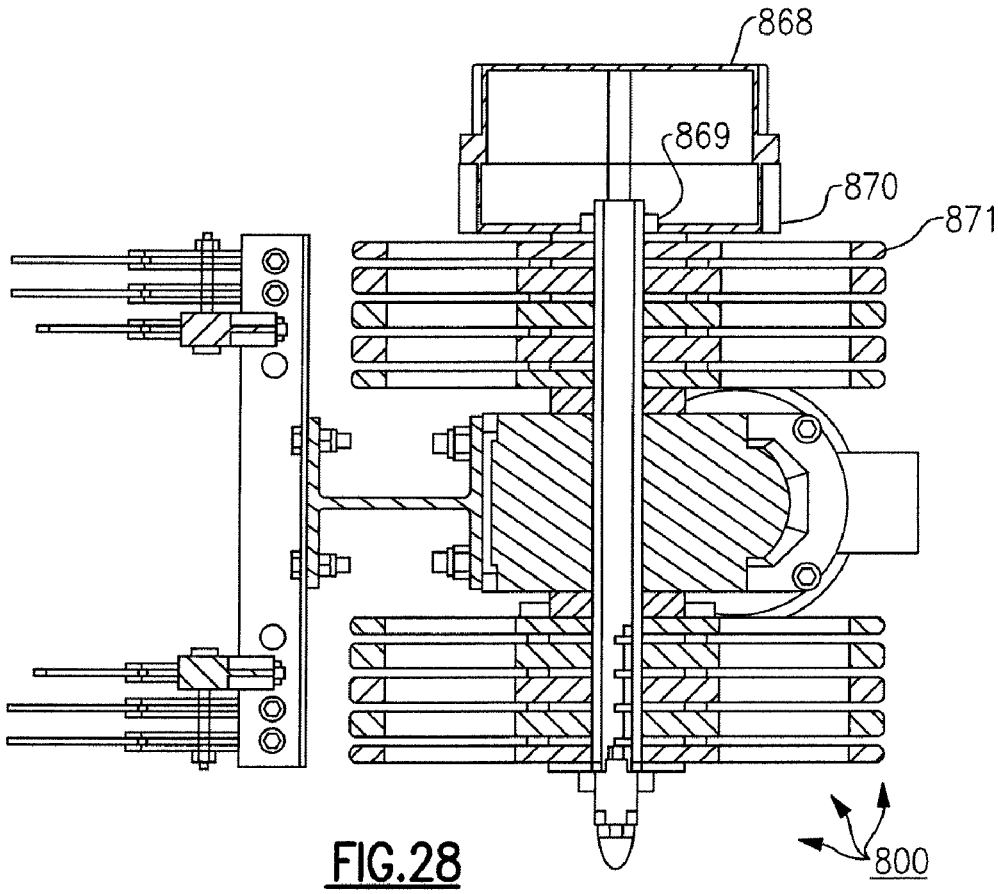
FIG. 28 is a cross sectional view of the sixth embodiment winch system.
Figure 29:
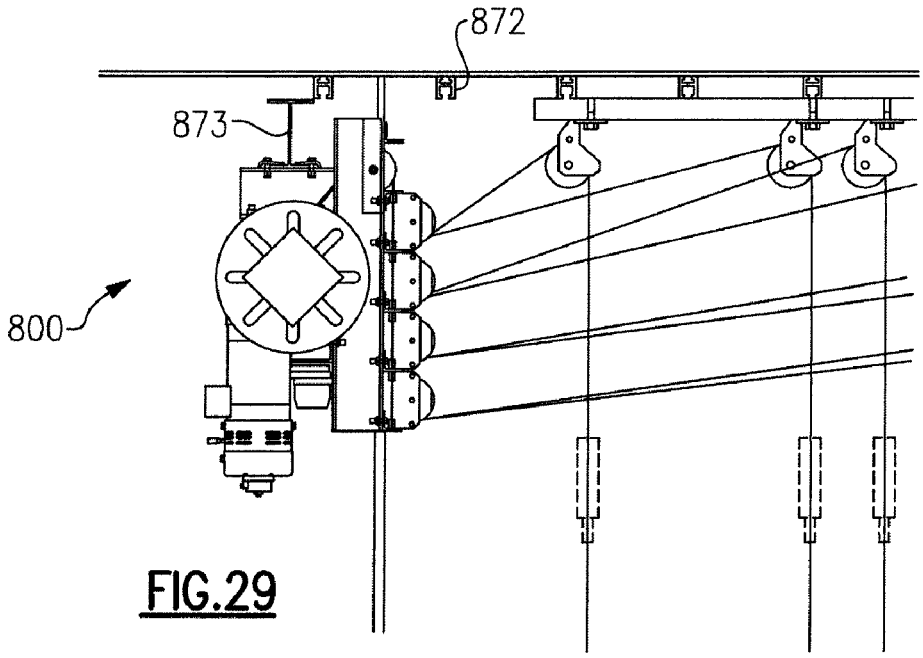
FIG. 29 is an orthographic side view of the sixth embodiment winch system supporting a load.
Figure 30:
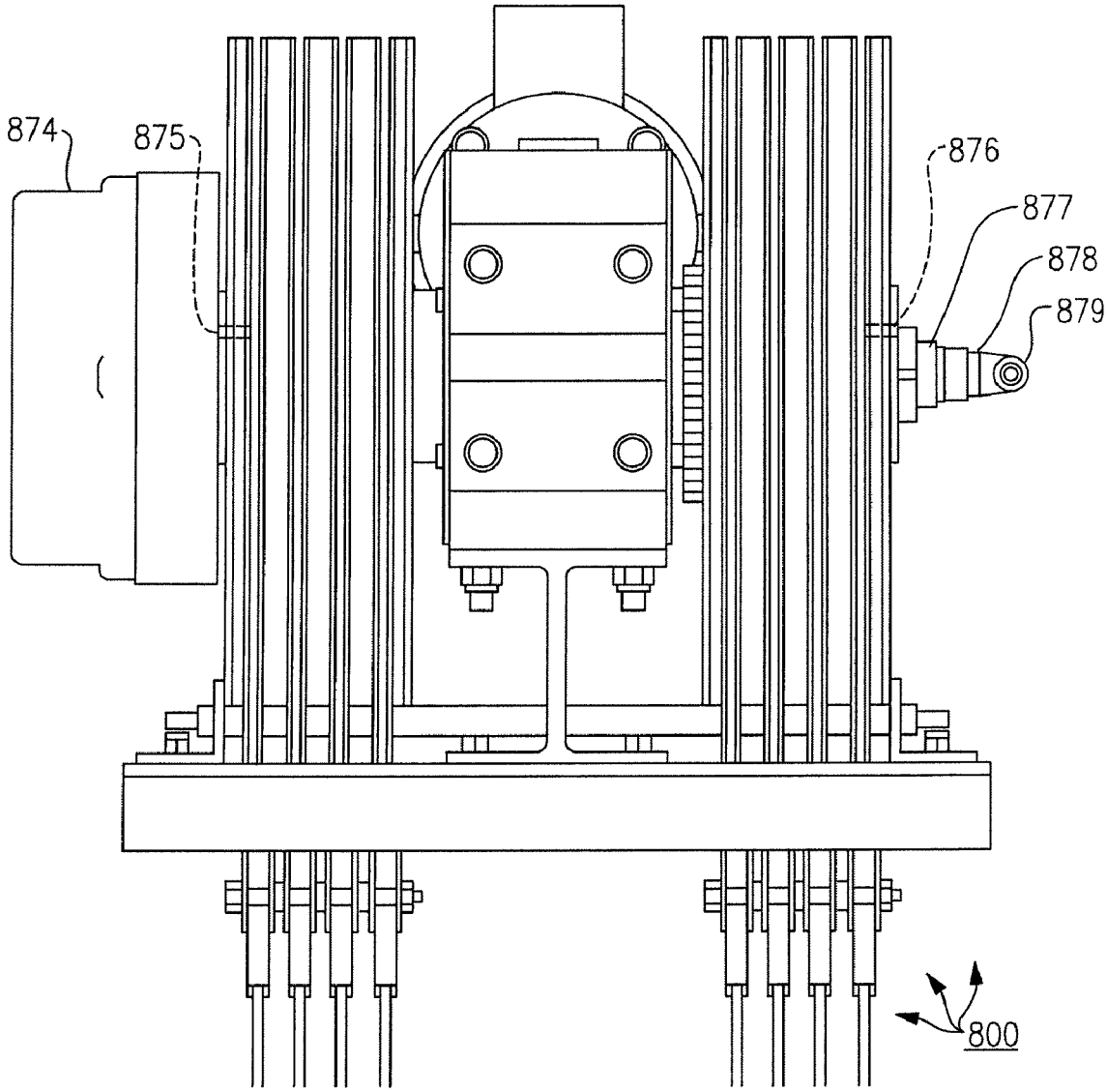
FIG. 30 is an orthographic top view of the sixth embodiment winch system.
Figure 31:
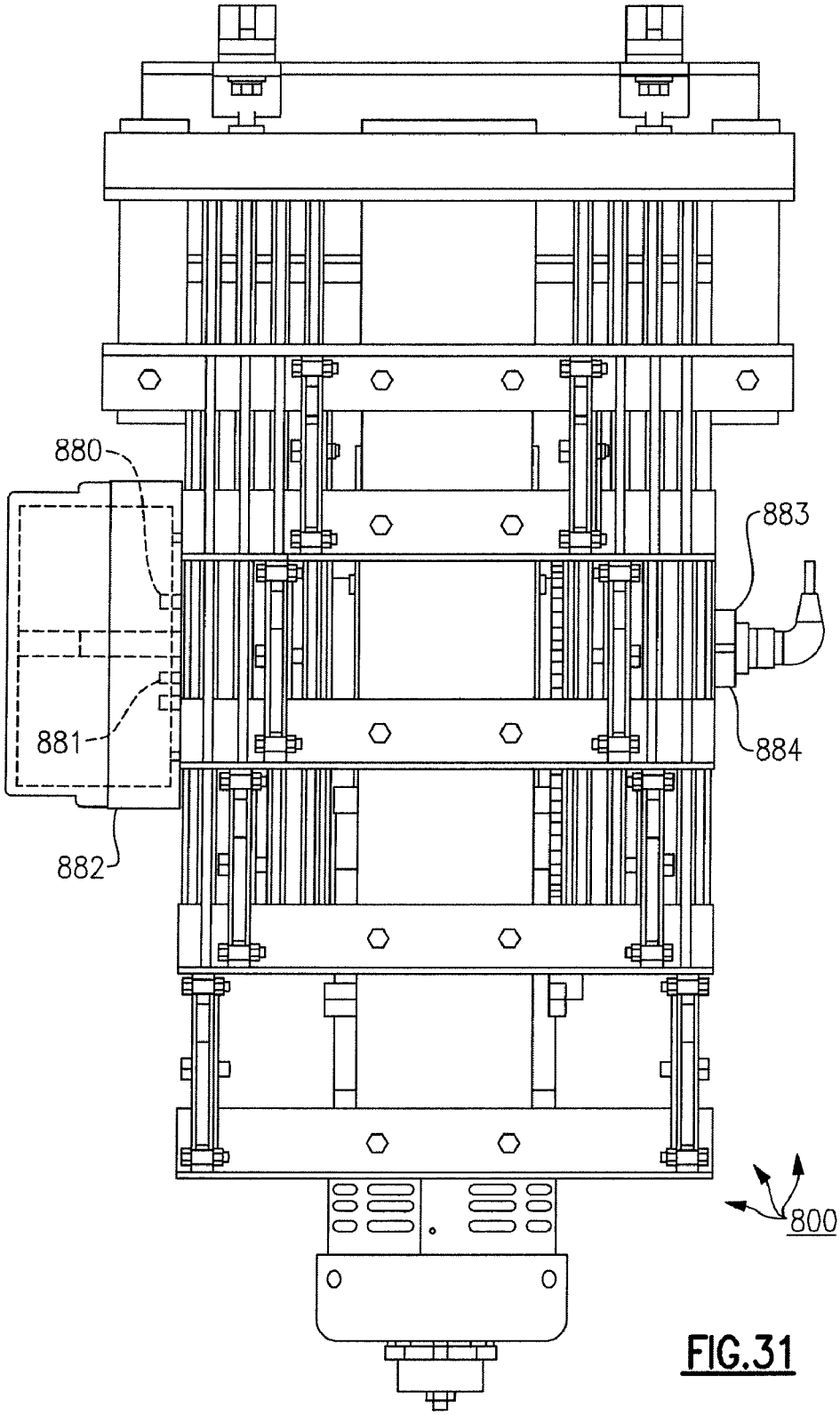
FIG. 31 is an orthographic front view of the fifth embodiment winch system.

FIGS. 23 to 25 show a preferred procedure for forming an eye termination, including the steps of: (783) cutting the force member to length; (787) knotting the end and cementing; (784) using 0.5 mm wire to guide a force member loop through oval sleeve 786; (788) pulling the loop over a thimble; (789) inserting the thimble and then removing slack so that the thimble cannot be removed; and (790) crimping the sleeve one half at a time to ensure full sleeve compression.

Some exemplary and potentially advantageous, but not necessarily required features, characteristics and/or specifications of system 700 will now be listed; (i) max travel=55 feet; (ii) max total load=850 lb at full travel; (iii) cable diameter 3/16 inch; (iv) yo-yo core 4.5 inch OD; (v) yo-yo OD 14.25 inch; (vi) gearbox is preferably a Motovario MNRV090140TC with dual output shaft and 50:1 ratio; (vii) motor is preferably a 1.5HP; (viii) motor design speed=1725 RPM; (ix) secondary reduction 3:1 ratio; (x) driver=20HB100SF (1.375 inch bore with square keyway and set screw); (xi) driven=60H100SF (50 mm bore with rectangular keyway on QD bushing); (xii) belt=420H100 (13.6 inch centers); (xiii) limit driver=35B30 (1.375 inch bore with keyway and set screw); (xiv) limit driven=35B22 (12 mm plain bore—pin to shaft); (xv) max speed output at OD=42 fpm; (xvi) min speed output ad id=18 fpm; (xvii) mechanical fs=1.37; and (xviii) unit weight=315 lbs.

FIGS. 26 to 31 show winch system 800 including: motor 802; eight (8) force cable assemblies 806; electrical commutator 808; pile up drum plates 810; strut grid 852; aluminum beam 854; bolt assemblies 856, 859, 860, 866, 880; clip plate 858; socket head cup point set screw 861; winch pivot sheave tree 862; label 863; motor assembly 864; limit assembly 865; ABS electrical enclosure 868 (preferably Hoffman Q181813ABE); shaft nut 869; drum flange plate; outer side pile up drum plate 871; unistrut grid 872; curved aluminum beam 873; enclosure 874; slotted spring pins 875, 876; socket head cup point set screw 877; rotating portion 877 of commutator 808; boot kit 879 (preferably Mercotac boot kit #57430); shaft nuts 881, 883, 884; and outer wall 882 of enclosure.

Some exemplary and potentially advantageous assembly procedures for system 800 will now be set forth. Initial Assembly: (1) assemble motor assembly as detailed on drawing T0210; (2) bolt pivot sheave tree (item 28) to motor gear box with (items 26 & 27); (3) route power and control feed cables ((1) Belden 9729 and (1) Belden 21917A) through hollow shaft. Drum Assembly—start with commutator side of winch drum: (4) slide ½" thick drum side plate (item 20) onto drive shaft; (5) slide drum core plate (item 17) onto drive shaft, seat firmly against drum side plate; (6) insert end fitting (item 16) of cable assembly (item 15) thru ⅝" hole in the core plate and into the side plate; (7) press strength and electrical conductors in groove as detailed in section D-D on drawing T0200; (8) pass leads of conductors thru slot in drive shaft, route through hollow shaft in the direction of the J-Box side of gear motor; (9) wrap cable around core one revolution; (1) reeve cable through diverter sheave and around its corresponding pivot sheave; (11) slide ¾" thick drum side plate (item 19) onto drive shaft, seat firmly against core plate; (12) repeat step 5-11 for next cable assemblies (items 14 & 13); (13) repeat steps 5-9 for cable assembly item 12; (14) slide ½" thick drum side plate (item 20) onto drive shaft, seat firmly against core plate; (15) slide drum flange plate (item 18) onto drive shaft, seat firmly against drum side plate; (16) place loktite red on threads of drive shaft and tighten nut (item 31) against drum assembly using a bearing nut wrench. Drum Assembly-J-Box side of winch unit: (17) repeat steps 4-16 for cable assemblies items 25, 24.23 & 22. Finish conductor cable routing commutator side: (18) plug power and control leads into commutator (item 2). Insert commutator into drum flange plate and seat in counter bore of drive shaft. Secure in place by tighten set screws (item 35). Finish conductor cable routing J-Box side: (19) remove lid from electrical enclosure, (item 1); (20) route all conductor leads coming out of hollow drive shaft through center hole in back of J-Box; (21) slide enclosure over top of shaft nut (item 31) and align 3 holes in back of J-Box with 3 tapped holes in drum flange plate (item 18); (22) secure J-Box to flange plate using items 32, 33 & 34; (23) coil conductors neatly and store in enclosure; (24) replace enclosure cover. Finish reeving cables: (25) power up winch and wind cable onto pile up drum. Maintain constant tension on cables to insure the cables wind evenly onto drums; (26) secure cable to prevent from un-spooling from drum; (27) neatly coil loose ends of cables and secure to winch frame for transport; (28) label cables for installation per winch schedule in drawing package; (29) make sure all cables are protected for transport and handling.

For system 800, some exemplary and potentially advantageous winch data are as follows: (1) channel number: 1-40; (2) load capacity: 160 lbs; (3) load speed: 60 FPM; (4) load travel: 66 FT; (5) Cable/Chain Qty: 8 ea.; (6) cable or chain size: 0.19 special; (7) Gear motor service factor: 1.56; (8) Mechanical strength service factor: 1.66; and (9) winch assembly weight: 190 lbs. For system 800, some exemplary and potentially advantageous gear motor data are as follows: (1) Model: Special—see T0210; (2) Motor Power: 1.5 HP, 230 VAC, 3 0(PH), 60 Hz; (3) Brake Power: 230 VAC 3 0(PH), 60 Hz; (4) Output speed: 46 RPM; (5) Output Torque: 1459 [LB-IN]; (6) Mounting position: V6; (7) Shaft location(s): hollow bore; (8) Shaft Dim. "EA": A=N/A, B=N/A; (9) Keyway Length(s): STD; (10) Conduit box location: See T0210; (11) Cable entry location: See T0210; (12) Encloder: Yes—Photocraft; and (13) High inertia fan: No. For system 800, some exemplary and potentially advantageous limit switch data: (1) up over travel: rotary; (2) up limit: rotary; (3) intermediate: N/A; (4) down limit: rotary; (5) down over travel: rotary; and (6) limit switch ratio: 50:1.

DEFINITIONS

The following definitions are provided to facilitate claim interpretation:

Present invention: means at least some embodiments of the present invention; references to various feature(s) of the "present invention" throughout this document do not mean that all claimed embodiments or methods include the referenced feature(s).

First, second, third, etc. ("ordinals"): Unless otherwise noted, ordinals only serve to distinguish or identify (e.g., various members of a group); the mere use of ordinals implies neither a consecutive numerical limit nor a serial limitation.

Electrically Connected: means either directly electrically connected, or indirectly electrically connected, such that intervening elements are present; in an indirect electrical connection, the intervening elements may include inductors and/or transformers.

Mechanically connected: Includes both direct mechanical connections, and indirect mechanical connections made through intermediate components; includes rigid mechanical connections as well as mechanical connection that allows for relative motion between the mechanically connected components; includes, but is not limited, to welded connections, solder connections, connections by fasteners (for example, nails, bolts, screws, nuts, hook-and-loop fasteners, knots, rivets, force fit connections, friction fit connections, connections secured by engagement added by gravitational forces, quick-release connections, pivoting or rotatable connections, slidable mechanical connections, latches and/or magnetic connections).

Data communication: any sort of data communication scheme now known or to be developed in the future, including wireless communication, wired communication and communication routes that have wireless and wired portions; data communication is not necessarily limited to: (i) direct data communication; (ii) indirect data communication; and/or (iii) data communication where the format, packetization status, medium, encryption status and/or protocol remains constant over the entire course of the data communication.

Receive/provide/send/input/output: unless otherwise explicitly specified, these words should not be taken to imply: (i) any particular degree of directness with respect to the relationship between their objects and subjects; and/or (ii) absence of intermediate components, actions and/or things interposed between their objects and subjects.

winch system: any system for moving an object by winding and unwinding a flexible elongated member from a rotating drum, where the tensile forces in the elongated member transmit force to move and/or suspend the load, without regard to: (i) the hardware used to rotate the drum (for examples, manual power, electrical motor); (ii) shape of the outer peripheral surface of the drum (for example, cylindrical); (iii) application of the winch (for examples, construction, theatre, warehouse, factory, home); and/or (iv) the geometry of the windings about the drum (for examples, pile up, kite string spool style).

To the extent that the definitions provided above are consistent with ordinary, plain, and accustomed meanings (as generally shown by documents such as dictionaries and/or technical lexicons), the above definitions shall be considered supplemental in nature. To the extent that the definitions provided above are inconsistent with ordinary, plain, and accustomed meanings (as generally shown by documents such as dictionaries and/or technical lexicons), the above definitions shall control. If the definitions provided above are broader than the ordinary, plain, and accustomed meanings in some aspect, then the above definitions shall be considered to broaden the claim accordingly.

To the extent that a patentee may act as its own lexicographer under applicable law, it is hereby further directed that all words appearing in the claims section, except for the above-defined words, shall take on their ordinary, plain, and accustomed meanings (as generally shown by documents such as dictionaries and/or technical lexicons), and shall not be considered to be specially defined in this specification. In the situation where a word or term used in the claims has more than one alternative ordinary, plain and accustomed meaning, the broadest definition that is consistent with technological feasibility and not directly inconsistent with the specification shall control.

Unless otherwise explicitly provided in the claim language, steps in method steps or process claims need only be performed in the same time order as the order the steps are recited in the claim only to the extent that impossibility or extreme feasibility problems dictate that the recited step order (or portion of the recited step order) be used. This broad interpretation with respect to step order is to be used regardless of whether the alternative time ordering(s) of the claimed steps is particularly mentioned or discussed in this document.

What is claimed is:

1. A winch system for moving a load, the system comprising:

a drum defining an outer surface, a central axis, an axial direction, an angular direction and a radial direction;

a drum rotating device;

a cable jacket;

a force member;

a current path; and an electrical commutator;

wherein:

the drum is sized, shaped, located and/or connected to selectively rotate the drum about its central axis;

the force member is sized, shaped and constituted to have sufficient tensile strength to move the load;

the force member extends at least: (i) at least once around the drum in the angular direction, and (ii) from the proximity of the outer surface of the drum in a direction away from the drum;

the current path extends at least: (i) from the electrical commutator to the outer surface of the drum, (ii) at least once around the drum in the angular direction, and (iii) from the proximity of the outer surface of the drum in a direction away from the drum;

the electrical commutator and drum are sized, shaped, connected and/or located so that at least a portion of the current path rotates about the central axis of the drum with the drum;

the electrical commutator is sized, shaped located and/or electrically connected to conduct electrical current between a non-rotating current input/output and a rotating end of the current path; and the cable jacket sized, shaped, connected and/or located to wrap around and mutually constrain a portion of the force member and a portion of the current path.

2. The system of claim 1 wherein the electrical commutator and current path are sized, shaped, electrically connected and/or constituted to conduct electrical current sufficient to provide power to operate a power consuming device.

3. The system of claim 1 wherein the electrical commutator and current path are sized, shaped, electrically connected and/or constituted to conduct an electrical data signal.

4. The system of claim 3 wherein the control signal is in the form of an analog data signal.

5. The system of claim 3 wherein the control signal is in the form of a digital data signal.

6. A winch system for moving a load, the system comprising:

a drum defining an outer surface, a central axis, an axial direction, an angular direction and a radial direction;

a drum rotating device;

a cable jacket;

a force member;

a digital data communication path; and a digital data commutator;

wherein:

the drum is sized, shaped, located and/or connected to selectively rotate the drum about its central axis;

the force member is sized, shaped and constituted to have sufficient tensile strength to move the load;

the force member extends at least: (i) at least once around the drum in the angular direction, and (ii) from the proximity of the outer surface of the drum in a direction away from the drum;

the digital data communication path extends at least: (i) from the digital data commutator to the outer surface of the drum, (ii) at least once around the drum in the angular direction, and (iii) from the proximity of the outer surface of the drum in a direction away from the drum;

the digital data commutator and drum are sized, shaped, connected and/or located so that at least a portion of the digital data communication path rotates about the central axis of the drum with the drum;

the digital data commutator is sized, shaped located and/or electrically connected to provide data communication between a non-rotating digital data input/output and a rotating end of the digital data communication path; and the cable jacket is sized, shaped, connected and/or located to wrap around and mutually constrain a portion of the force member and a portion of the digital data communication path.

7. A winch system for moving at least one load(s), the system comprising:

a winch frame;

a motor assembly comprising a motor;

a drum defining a central axis, an axial direction, a radial direction, an angular direction, first end and a second end;

an electrical commutator comprising a first electrical input/output;

a winch junction box;

a first in-drum electrical line;

a first to-load electrical line; and a first force member;

wherein:

the motor assembly, drum and electrical commutator are each mechanically connected to the winch frame;

the motor assembly is operatively connected to the drum to drive the drum to rotate about its central axis relative to the winch frame;

the drum further defines an outer peripheral surface, an axial hole extending from the first end to the second end, and a first radial hole extending from the axial hole to the outer peripheral surface;

the electrical commutator is located proximate to a potion of the axial hole at the first end;

the junction box is located proximate to a portion of the axial hole at the second end and is mechanically connected to the drum so that it rotates with the drum about the central axis of the drum;

the first in-drum electrical line extends from the electrical commutator to the junction box through the axial hole, is electrically connected to the first electrical input/output by the electrical commutator, and is electrically connected to the first to-load electrical line by the junction box;

the first to-load electrical line is located to extend: (i) from the junction box into the axial hole, (ii) from the axial hole into the first radial hole, (iii) through the first radial hole to the outer peripheral surface of the drum, (iv) at least once around the outer peripheral surface of the drum in the angular direction of the drum, and (v) away from the outer peripheral surface of the drum;

the electrical commutator, junction box, axial hole and first radial hole are structured, located and/or connected so that the first in-drum electrical line and at least a portion of the first to-load electrical line rotate with the drum about the central axis of the drum;

the first force member is structured and constituted to withstand tensile forces associated with moving the load(s); and at least a portion of the first force member is constrained to a portion of the first to-load electrical line to form a first power cable assembly extending from at least: (i) the outer peripheral surface of the drum, (ii) at least once around the outer peripheral surface of the drum in the angular direction of the drum, and (iii) away from the outer peripheral surface of the drum.

8. The system of claim 7 further comprising a first cable jacket sized, shaped, connected and/or located to wrap around a portion of the first force member and a portion of the first to-drum electrical line to provide the constraint that forms the first power cable assembly.

9. The system of claim 7 wherein:

the first force member comprises a cable pin thimble located at an end of the force member;

the drum defines a first thimble recess extending from the outer peripheral surface of the drum; and the cable pin thimble is located in the cable pin recess.

10. The system of claim 7 further comprising:

a first radial guide flange extending in the radial direction from the outer surface of the drum; and a second radial guide flange extending in the radial direction from the outer surface of the drum;

wherein the first power cable assembly extends around the outer peripheral surface of the drum between the first radial guide flange and the second radial guide flange in a yo-yo winding geometry.

11. The system of claim 7 further comprising a second to-load electrical line, wherein:

the first in-drum electrical line is electrically connected to the second to-load electrical line by the junction box; and the second to-load electrical line is located to extend generally parallel to the first to-load electrical line; and the electrical commutator, junction box, axial hole and first radial hole are structured, located and/or connected so that at least a portion of the second to-load electrical line rotates with the drum about the central axis of the drum.

12. The system of claim 7 further comprising:

an electrical commutator comprising a first electrical input/output;

a second in-drum electrical line; and a second to-load electrical line;

wherein:

the electrical commutator further comprises a second electrical input/output;

the second in-drum electrical line extends from the electrical commutator to the junction box through the axial hole, is electrically connected to the second electrical input/output by the electrical commutator, and is electrically connected to the second to-load electrical line by the junction box;

the second to-load electrical line is located to extend to extend generally parallel to the first to-load electrical line; and the electrical commutator, junction box, axial hole and first radial hole are structured, located and/or connected so that at least a portion of the second to-load electrical line rotates with the drum about the central axis of the drum.

* * * * *